US009659417B2

(12) United States Patent
Rybak et al.

(10) Patent No.: US 9,659,417 B2
(45) Date of Patent: May 23, 2017

(54) SYSTEMS AND METHODS FOR EXTRACTION AND TELEMETRY OF VEHICLE OPERATIONAL DATA FROM AN INTERNAL AUTOMOTIVE NETWORK

(75) Inventors: Ihor Bohdan Rybak, Mississauga (CA); Daniel Wood, Moncton (CA); Judson Murray, Moncton (CA); Andy Janes, Moncton (CA); Matthew Pichette, Moncton (CA)

(73) Assignee: VINVOX INTERNATIONAL CORP., Moncton, N.B. (CA)

( * ) Notice: Subject to any disclaimer, the term of this patent is extended or adjusted under 35 U.S.C. 154(b) by 24 days.

(21) Appl. No.: 13/976,586

(22) PCT Filed: Jan. 3, 2012

(86) PCT No.: PCT/CA2012/000008

§ 371 (c)(1),
(2), (4) Date: Oct. 8, 2013

(87) PCT Pub. No.: WO2012/092668

PCT Pub. Date: Jul. 12, 2012

(65) Prior Publication Data

US 2014/0025253 A1 Jan. 23, 2014

Related U.S. Application Data

(60) Provisional application No. 61/429,362, filed on Jan. 3, 2011.

(51) Int. Cl.
*G07C 5/08* (2006.01)

(52) U.S. Cl.
CPC ..... *G07C 5/0858* (2013.01); *G07C 5/085* (2013.01)

(58) Field of Classification Search
None
See application file for complete search history.

(56) References Cited

U.S. PATENT DOCUMENTS 5,729,452 A * 3/1998 Smith et al. ..... 701/31.9
8,019,503 B2 * 9/2011 Andreasen et al. ..... 701/29.6
(Continued)

OTHER PUBLICATIONS

International Searching Authority, International Search Report, Corrected Version, dated Jun. 12, 2012, issued in PCT/CA2012/000008.
(Continued)

*Primary Examiner* — John R Olszewski
*Assistant Examiner* — Navid Ziaeianmehdizadeh
(74) *Attorney, Agent, or Firm* — Norton Rose Fulbright Canada LLP

(57) ABSTRACT

Systems, methods, and related computer programs are provided wherein vehicle operation data is extracted from an internal automotive network. In an embodiment, a method comprises: i) obtaining data available on the internal automotive network via iterative interrogation; ii) analyzing the obtained data to identify a set of candidate data values having at least one common feature within a suitable proximity margin; and iii) heuristically selecting a candidate data value best matching one or more selection criteria to identify a true value. These systems and methods allow data to be extracted from proprietary and non-proprietary busses in the internal automotive network.

24 Claims, 28 Drawing Sheets

(56) References Cited

U.S. PATENT DOCUMENTS

| | | | | |
|---|---|---|---|---|
| 2004/0167689 | A1 | 8/2004 | Bromley et al. | |
| 2005/0278146 | A1* | 12/2005 | Nitsche et al. | 702/183 |
| 2006/0022842 | A1 | 2/2006 | Zoladek et al. | |
| 2006/0041337 | A1 | 2/2006 | Augsburger et al. | |
| 2006/0229777 | A1* | 10/2006 | Hudson | G01M 15/05 701/31.4 |
| 2008/0147245 | A1 | 6/2008 | Koepf et al. | |
| 2008/0294690 | A1* | 11/2008 | McClellan et al. | 707/104.1 |

OTHER PUBLICATIONS

International Bureau of WIPO, International Preliminary Report on Patentability and Written Opinion, dated Jul. 10, 2013, issued in PCT/CA2012/000008.

Rleale, Oh, no Odometer: Reading and Righting . . . er, Writing, Aug. 2, 2010 (Aug. 2, 2010), available at http://www.canbushack.com/blog/index.php?title=oh-no-odometer-reading-and-righting-er-writing&more=1&c=1&tb=1&pb=1, retrieved Jan. 30, 2015.

* cited by examiner

SYSTEMS AND METHODS FOR EXTRACTION AND TELEMETRY OF VEHICLE OPERATIONAL DATA FROM AN INTERNAL AUTOMOTIVE NETWORK

FIELD OF THE INVENTION

The present disclosure relates generally to technologies for vehicle monitoring, and more particularly to a system and method for extraction of vehicle operation data from an internal automotive network. The present disclosure further relates to telemetry systems for extracting real time or near real time information.

BACKGROUND

There are a number of prior art technologies that enable the collection of data regarding the operation of a vehicle ("vehicle operation data"), which may include engine performance information, data indicating an engine malfunction or the likelihood of a malfunction occurring, travel speed and distance and other information associated with the operation of the vehicle. For example, speedometers, accelerometers, GPS technologies or a combination thereof may be used.

Moreover, consumer-oriented land vehicles manufactured in the last decade, including most automobiles and light trucks, incorporate an internal automotive network of electronic computers or electronic control units ("ECUs") to regulate and optimize the performance of those vehicles, and to provide self-diagnostic information to signal the presence of faults and aid in their resolution. Access to this internal automotive network can be gained through an OBD-II diagnostic port of the vehicle. High-level OBD-II communications protocol was established as a compulsory standard for example for all North American vehicles manufactured since 1996.

There are a number of prior art technologies that utilize OBD-II ports to gather vehicle operation data for a number of purposes. The original purpose of OBD-II ports is to enable the gathering of vehicle operation data for diagnostic purposes, usually by a vehicle maintenance technician or vehicle mechanic. This gathering of vehicle operation data usually happens in conjunction with a service visit where a device is connected temporarily to the OBD-II port to extract the vehicle operation data. These prior art technologies are relatively affordable, but they generally do not provide information that is reliable enough to provide an accurate snapshot of "vehicle health" at any particular point in time during the operation of the vehicle.

Also, the location and environment of the OBD-II port may vary depending on the model and make of the vehicle. This varying location and environment can pose challenges in designing a device that can be connected to and remain connected to the OBD-II port, that remains easy to install in a broad range of vehicles, and that does not interfere with the convenient operation of the vehicle. It should be noted that if the location of the OBD-II port is often in a location that is likely to come into contact with the vehicle operator during use, and a device designed to extract information from the OBD-II port will likely be of a size that increases the likelihood of this contact, and this can result in a hazard to safe operation of the vehicle and/or damage to the device. In certain vehicles, the OBD-II port is in the lower regions of the front panel of the vehicle, and is likely to come into the contact with the feet of the operator during normal use of the vehicle pedals. Alternatively, in other vehicles the OBD-II port is in a location that is highly visible and some users may disconnect the device because the device does not appeal visually. In still other vehicles, the OBD-II port is located behind an access door, which cannot be closed if a device is installed in the port, making such an installation untenable due to reasons of potential interference with the physical controls, or aesthetics in a visible area of the passenger compartment.

One problem of prior art designs is that they do not address the differences in physical configuration of the interior of vehicles, which reduces the universality of such devices for obtaining vehicle operation data, or devices need to be replaced because of damage due to physical contact with the device by vehicle users as a direct result of the location of the device.

Another limitation of prior art technologies is that they cannot effectively extract certain types of vehicle data, particularly if the data is only available by using a manufacturer-specific, non-OBD protocol and/or by accessing the manufacturer's proprietary bus(es).

Onboard vehicle information systems such as OnStar™ obtain and transmit meaningful vehicle operation data on a wireless basis, however, such systems are relatively expensive to produce and maintain.

There is a need for a system and method that addresses the aforesaid disadvantages. In particular there is a need for a system and method for collecting vehicle operation data that is accurate, using a device that is affordable. There is a further need for a system that enables the collection of vehicle operation data efficiently, and in a way that enables the vehicle operation data to be leveraged using a variety of systems.

SUMMARY

The present system and method relates to extraction of vehicle operation data from an internal vehicle or automotive network. Access to this network can be gained through the OBD-II diagnostic port of the vehicle, and by interrogation of the various electronic control units or ECUs connected to the internal automotive network.

In one aspect, there is provided a computer-implemented method for extracting vehicle operation data from an internal automotive network, comprising: i) obtaining data available on the internal automotive network via iterative interrogation; ii) analyzing the obtained data to identify a set of candidate data values having at least one common feature within a suitable proximity margin; and iii) heuristically selecting a candidate data value best matching one or more selection criteria to identify a true value.

In another aspect of the invention a novel vehicle data telemetry system is provided, including a device that enables the collection/generation of vehicle operation data and the wireless transfer of the vehicle operation data to a host system for consumption by one or more applications. The vehicle data telemetry system of the present invention includes a data harvesting device that is operable to extract information from a diagnostic port of a vehicle, and if necessary process the extracted information so as to generate vehicle operation data, for a range of makes and models of vehicles. The data harvesting device is further operable to transmit the vehicle operation data wirelessly to the host system, where the host system makes the vehicle operation data to a range of applications or services (including web services or cloud services).

In this respect, before explaining at least one embodiment in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 1A:
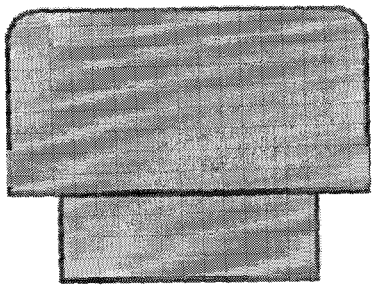
FIG. 1*a* is a drawing of a representative embodiment of a device in accordance with an embodiment, in this case a one-part embodiment of the data harvesting unit.

In the drawings, various embodiments of the present systems and methods are illustrated by way of example. It is to be expressly understood that the description and drawings are only for the purpose of illustration.

DETAILED DESCRIPTION

The term "vehicle" is used extensively in this disclosure and refers to any sort of powered mobile transportation device, including passenger vehicles as well as industrial equipment, commercial vehicles, automated equipment, robots, aerial conveyances, etc.

The present disclosure relates to a system and method for extraction of vehicle operation data from an internal automotive network. Access to this internal automotive network may be gained through the OBD-II diagnostic port of the vehicle, and by interrogation of the various electronic control units connected to the internal automotive network.

Vehicle operation data can be gathered from one or more vehicles by means of a data port provided by the vehicle. The data may be logged by operation of one or more computers and made accessible to one or more groups of stakeholders which may include vehicle owners, dealers, manufacturers and others, either on a per-vehicle basis or aggregated basis, in order to support a variety of new operations that rely on access to real-time or near real-time vehicle operation data such as vehicle maintenance alerts, and scheduling and loyalty programs. It should be understood that vehicle operation data refers generally to the data that the data harvesting device of the present invention is configured to log and transfer to the host system. This day may consist of raw data extracted from the internal computer network of the vehicle and/or raw data processed by operation of the on-board processing/analysis functionality of the data harvesting device, as explained below.

The data gathering device relies on a vehicle data port. The most common data port is the OBD-II port or second generation On-Board Diagnostic port, and therefore the disclosure refers throughout to the OBD-II port. However, the invention is not limited to configurations designed to connect to the OBD-II port technology. Some vehicles include other types of ports such as the J1939 diagnostics port. Also, the OBD-II port technology may be replaced by successor technology. The data harvesting unit can easily be modified to connect with such other ports. Also, the system, as described below, can be adopted to use data available from a range of other similar data ports, even used to obtain diagnostic information from non-vehicle systems.

Data Harvesting Unit or Device

In a particular implementation, the data harvesting unit it best understood as a sensor unit that is configured to gather operational/maintenance information of a vehicle via a data port, optionally process the information (based on rules embodied in the data harvesting unit) and communicate the information regularly via wireless communication.

FIG. 1*a* illustrates a representative configuration of the data harvesting unit that is organized in a one-piece configuration that is operable to connect to a data port. The one-part embodiment includes the main components described in greater detail in connection with the two-part embodiments shown in FIGS. 2*b* to 2*g*.

The data harvesting unit generally includes: (a) a physical connector for connecting to the data port, (b) a micro-computer, (c) a storage medium, and (d) a wireless communication component, where (a) is connected to (b), and (c) and (d) are connected to (b).

Figure 1B:
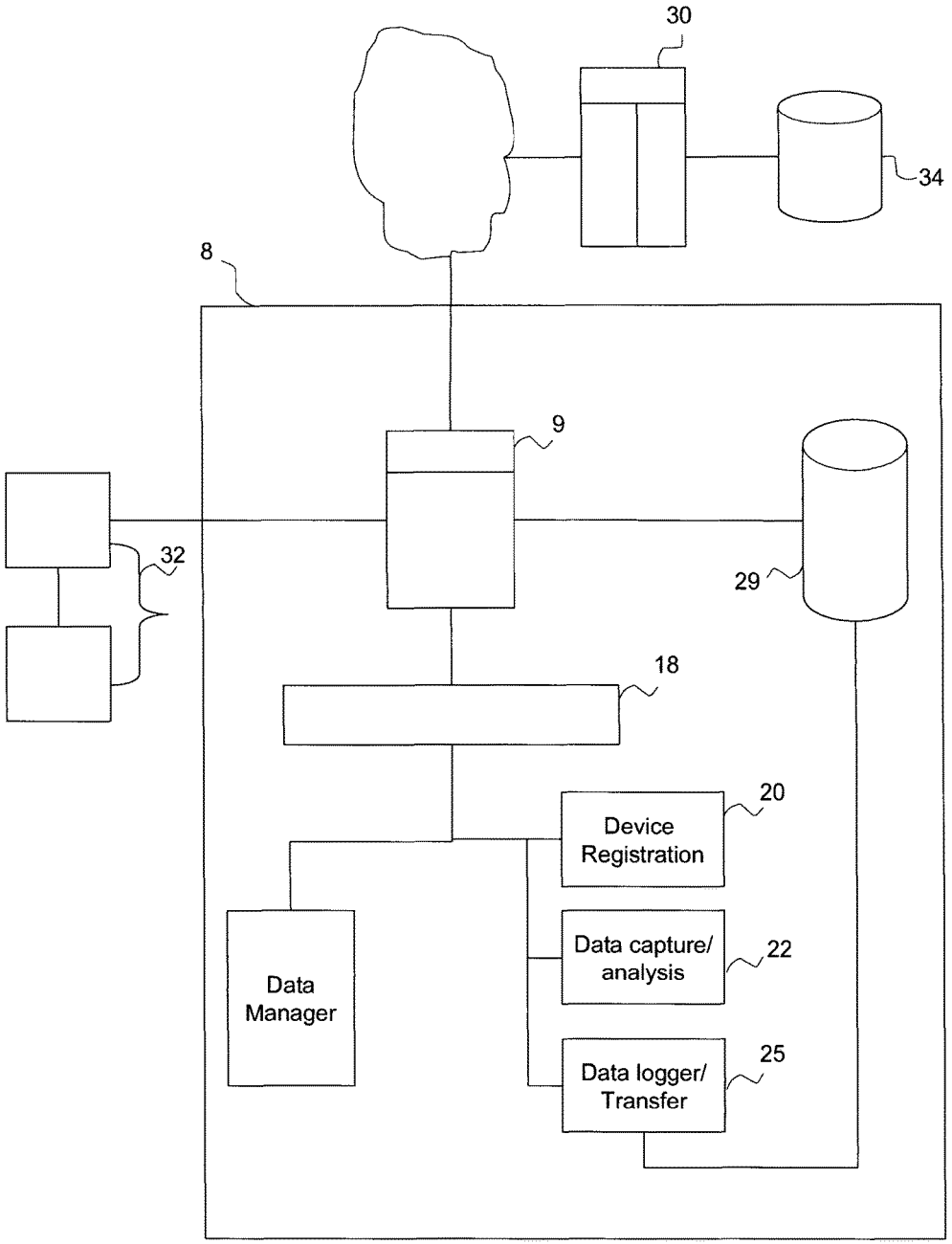
FIG. 1*b* is a system diagram of the system and device of the present invention.

As best shown in FIG. 1*b*, which represents a representative system implementation of the present invention, a data harvesting unit 8 (which may also be referred to as the "data harvesting device") includes a micro-computer 9 is linked to a device computer program 18 that is operable to provide instructions to the micro-computer 9 to define a (A) device registration component 20, and (B) a data capture/analysis component 22, and (C) a data logging and transfer component 24. The device computer program 18 optionally includes a data manager 25 that incorporates parameters, configurations, and/or rules that determine the data capture/analysis/logging/transfer functions of the data harvesting unit 8.

The data harvesting unit 8 is configured to connect to connect to a remote host system 30 which may be implemented in a number of different ways including as a web server or a cloud network implemented service.

The data manager 25 may define the rules for transfer of vehicle operation data from the data harvesting unit 8 to the host system 30. The data manager 25 may determine for example the analysis of raw data from the internal network 32 of the vehicle on-board or via host system 30 after transfer. The data manager 25 is also operable to manage functions of other utilities of the data harvesting device 8 for example device registrations operations of the device registration component 20, data capture/analysis operations of the data capture/analysis component 22, and various data logging/transfer functions of the data logging/transfer component 26.

The data manager 25 provides for the general efficient and effective operation of the data harvest unit 8, including from an overall telemetry solution perspective, a wireless data service cost perspective, and the provisioning of ready to use vehicle operation data to the host system 30. These various parameters related to efficient and effective operation of the system of the present invention may be embodied in a series of rules implemented to the data manager 25 and may be referred to as "operation parameters" for the data harvest unit in the present disclosure.

Regarding data logging, the data harvesting device 8 includes a data store 29 and the data manager 25 determines the logging and storage of vehicle operation data until the operation parameters provide for the transfer of the vehicle operation data via a wireless network interface 28 incorporated in the data harvesting device 8, to a wireless network, and by means of the wireless network to the host system 30, for example via wireless gateway (not shown). In some embodiments of the invention, the data manager 25 provides for the storage of vehicle operation data for transfer to the host system 30 once this is possible based on network availability and other factors such as network service cost optimization. It should be understood that the present invention contemplates the integration of various technologies for managing and optimizing wireless connections and transfers based on a variety of parameters. For example, the data manager 25 may incorporate a network selector that incorporates state of the art technology in this domain, triggering, for example, the transfer of vehicle operation data to the host system 30 during times when low cost networks are available; increasing the frequency of transfers when lower cost networks are available; decreasing the frequency of transfers when only higher cost networks are available; varying the frequency of transfer based on cost versus ranking of logged data based on pre-determined importance or relevance criteria, and so on.

Significantly, operation parameters may vary significantly, and based on the requirements of platform customers or applications that consume vehicle operation data for example, it may be desirable to update the operation parameters from time to time. The data manager 25 is operable to co-operate with the host system 30 to obtain updates to the operation parameters or in fact program updates to the various components of the data harvesting unit 8. In this way, in one aspect of the invention, a plurality of data harvesting units 8 may be linked to a host system 30 to provide for a telemetry network wherein the host system gathers vehicle operation data from multiple vehicles for example for further processing, or for consumption as part of one or more processes or applications.

The device registration component 20 is operable to register the data harvesting unit 8 with one or more remote computers providing host system 30. The data logging/transfer component 24 is operable to acquire vehicle operation data, in part by accessing data from the data port, and also processing the data as explained below, in order to create vehicle operation data which may constitute enhanced data relative to the data available from the data port. Vehicle operation data may be stored to the storage medium or data store 29, to enable wireless communication of the vehicle operation data via the wireless communication component on an intermittent basis as further explained below.

It should be understood that the data harvesting unit 8 through its various components provides data extraction functionality. There are a number of aspects of useful vehicle operation data that be obtained directly from data obtained from the data port, for example, an OBD-II port, and there is a need to extract this data by embodying extraction operations into the data harvesting utility 8.

What follows is a particular implementation of this data extraction capability. For example, the updating capability mentioned above, enables the provision of configuration data to the data harvesting device 8 is provided to the device, or embodied in the device, that enables the data harvesting unit 8 to obtain specific data such as real time odometer values from the data stream accessible through the OBD port. For example, as is evident from the device specifications explained below, the data harvesting device 8 is configured through the data manager 25 to analyze raw data from the OBD-II port and extract data sets of interest based on the operation parameters. This can be accomplished for example by obtaining a suitable code element such as an arbitration ID (which operates as a header) for a particular data set, accessing applicable rules to apply in order to query the OBD-II port, or process data sets from the OBD-II port to obtain dynamically from the string the desired data, which rules are embodied in the data manager 25, thereby obtaining information of interest such as odometer information. The querying strategy/extraction logic is embodied in the operations of the data harvesting device 8 as further explained below.

It should be understood that the operator of the host system 30 may have access to or obtain access to a library that includes processing rules for processing OBD data based on standardized published codes, as well as rules for processing non-OBD data which is dependent on the model and make of the vehicle and which is compiled through direct analysis of such vehicles. This library may be stored in a database 34 linked to the host system 30 and may be used to establish configuration data for the data harvesting unit 8, particular for the model and make of the vehicle to which the device is installed. This information may be updated from time to time at the database 34, and the configuration of the system described above, may enable this information to be updated and implemented at the various data harvesting devices 8 depending on the then applicable processing rules. These processing rules are embodied into configuration data, and configuration data is made part of the updating of the data manager 25 functionality as described above.

Either the model and make is known prior to configuration of a device for a particular vehicle, or this information is obtained or extrapolated from the VIN information, and then accessed from the storage medium or by communication with the remote server(s). It should also be understood that through the configuration data, the data harvesting utility is operable to obtain the desired information with an optimal number of commands.

Depending on the specific data element to be harvested by the device, discrete data values will be yielded through the standardized OBD communications protocol or through a non-OBD protocol such as the ISO 15765-4 signaling standard, a variant of the Controller Area Network (CAN) bus protocol. For example the communication pattern used by the data harvesting unit 8 to query vehicle internal network 32 may take the form of a request-response interaction wherein there is a specific response code returned in answer to a specific request code, or a monitoring mode wherein the data harvesting device 8 acts as a listener to analyze the free flow of data packets on the vehicle internal network bus until detecting the specific data elements required. The configuration data may include for example pre-loaded and/or remotely loaded communication templates defining necessary patterns of communication required for each discrete data element to be collected. This communication template may include data request codes, framing specifications for the response, and an indication of whether the response is a single or multi-frame data packet.

One feature of the invention is that the data harvesting device 8 is operable to map each data element to be requested, whether OBD or non-OBD, to a compact representation of the codes and/or commands to be used in collecting that data from the vehicle's internal network 32. An important aspect of the present invention is that the host system 30 co-operates with the data harvesting unit 8 to implement one or more discovery routines that enables the querying of the vehicle's internal network 32 to obtain configuration data that enables the extraction of the information. These discovery routines may be implemented and managed by operations of the analytics engine discussed below. The output of data discovery includes intelligence collected by the host system 30 that enables the improved of system data extraction capabilities overall, covering multiple makes and models of vehicles. Of particular interest, is that these data discovery routines are automated, which enables the system of the present invention to interoperate with a wide range of vehicles, and also for the data extraction operations to be updated automatically in the event of additional changes that are not published by the vehicle manufacturers, or there is a delay in publication that would otherwise result in a decrease in the range of effectiveness of the system.

In a particular aspect, the parsing and interpretation of the codes into usable information may be performed within the data harvesting device 8 using a pre-loaded or remotely-loaded map that the data manager 25 is operable to load to the map from the vehicle's data bus for transmission to the host system 30 for consumption upon receipt.

Accordingly, the system of the present invention is operable to obtain and transfer real-time or near real-time vehicle operation data such as, significantly, odometer information rather than approximate odometer information which is what prior art systems rely on. The access to accurate odometer information in particular, and other aspects of vehicle operation data besides, feeds a number of valuable systems and processes described below including enhanced scheduling, vehicle-related marketing and loyalty programs, and other processes or applications that may rely on vehicle operation data.

It should be understood that the various components or utilities described are but a representative implementation of functions that may be implemented using less or more functional components such as software modules. The various functions of the data harvesting unit 8 may be implemented as firmware for example. It should be understood that in an alternative embodiment, the logic and operations defined by the device computer program 18 may be hardwired to the data harvesting device 8.

In the one-part embodiment of the device, the components described above are arranged within a single housing.

The one-part embodiment is suitable for vehicles where the data port is located such that regular contact between the vehicle user or passengers and the data harvesting unit is unlikely. Regular contact may cause damage to the unit and therefore is preferably avoided. Also, for some vehicle owners, it is not desirable for the data harvesting unit to be in full view, regardless of the design of the casing. Depending on these factors, for certain vehicles, the one-piece configuration may or may not be optimal. The two-part embodiment explained below in part addresses these issues.

It should be noted however that the one-part embodiment does have certain advantages over the two-part embodiment. The one-part embodiment provides a marginally faster installation than the two-part embodiment, although the difference is in the 30 second range and therefore is not considered to be significant.

In the case of the one-part embodiment of the data harvesting unit, the antenna for wireless communication with the remote computer(s) is disposed inside the housing for the data harvesting unit, much as the antenna or antennas are disposed within the housing for a mobile communication device such as a cell phone or smart phone.

Figure 2A:
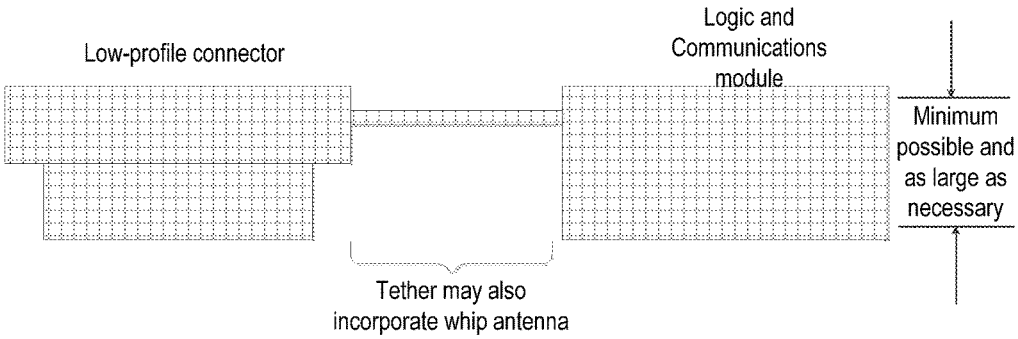
FIG. 2*a* depicts one embodiment of the data harvesting unit, in a two-part embodiment.
Figure 2B:
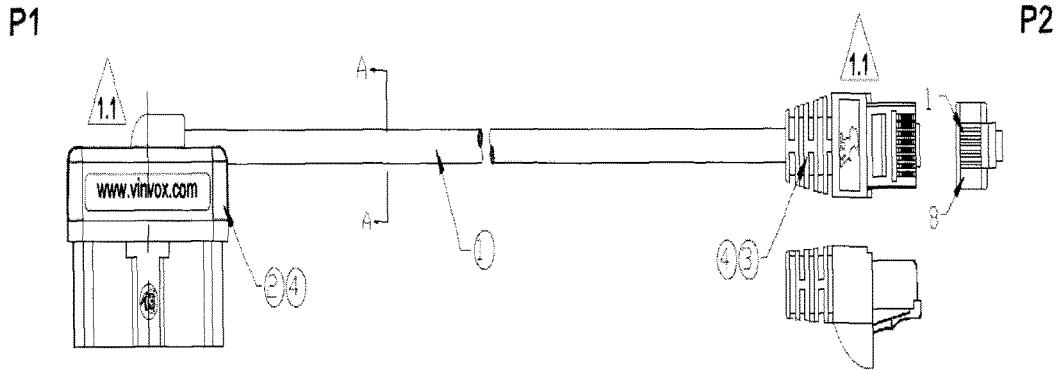
FIGS. 2*b* to 2*f* depict particular embodiments of two-part embodiments of the data harvesting unit, in a "left side" configuration thereof to accommodate the various physical positions of the OBD port within the car.
Figure 2C:
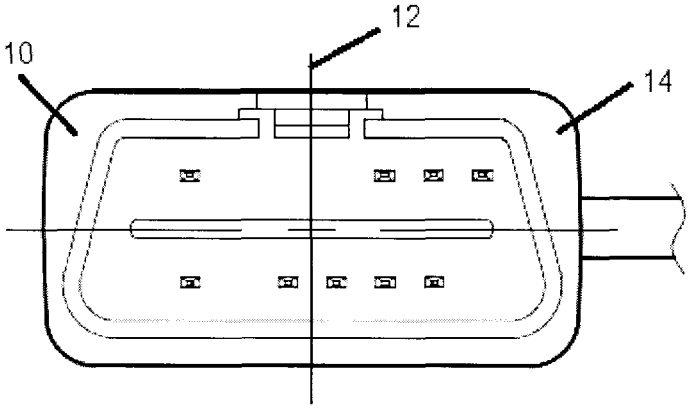
Figure 2D:
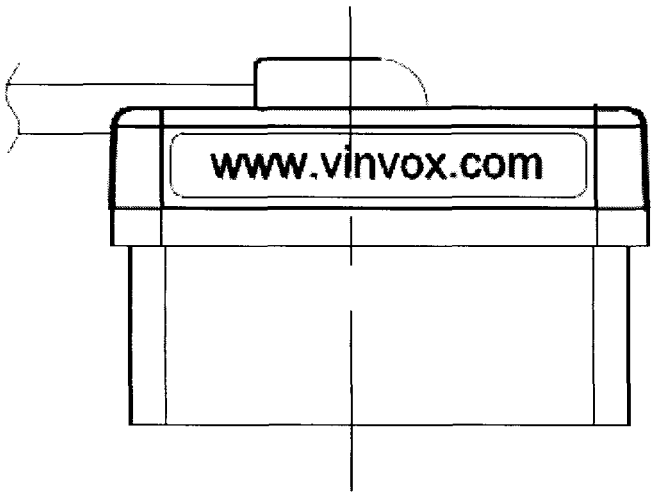
Figure 2E:
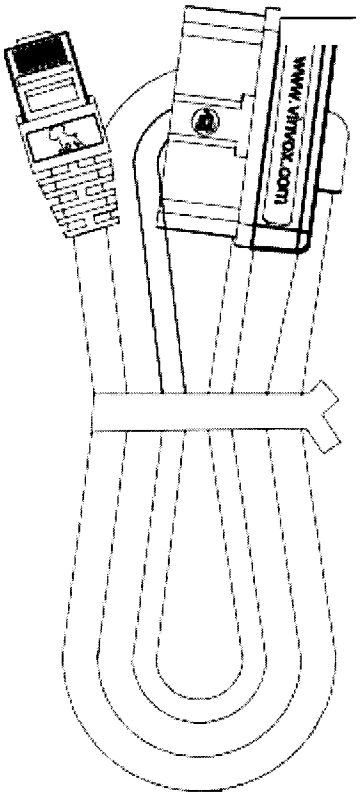
Figure 2F:
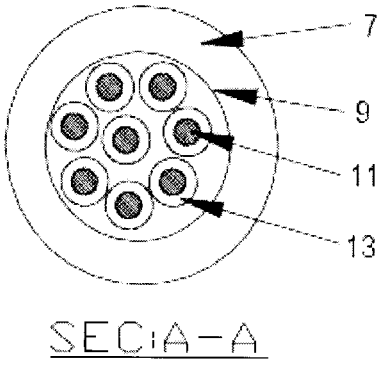

FIGS. 2*b* to 2*g* illustrate an alternate embodiment of the data harvesting unit, in this case a two-part embodiment thereof. In the case of the of two-art embodiment, as best illustrated in FIG. 2*b*, a first part 10 of the data harvesting unit includes the physical connector, enclosed in a small housing which provides a low profile connector that is physically and visually unobtrusive. The first part 10 connects to the data port. A second part 12 of the data harvesting unit includes the remaining components of the data harvesting unit described above and is installed in a location that is unobtrusive depending on the physical characteristics of the vehicle in question.

The first part 10 and the second part 12 are connected by a tether 14 of suitable length. The tether 14 may provide a connection such as an RJ-45 connector having a male connector on the tether 14 and a corresponding female connector on the second part 12 which includes the main receiver components discussed above. In most installations, the first part 10 is connected to the data port, and then the second part 12 is mounted in a location that is unobtrusive.

In one particular implementation of the two-part embodiment, one or more antennas are disposed within the tether 14 as best illustrated for example in FIG. 2*b*.

The two-part embodiment has a number of advantageous characteristics. These include: (a) easy installation in almost all passenger vehicles with little or no interference with driver, or damage to device due to contact; (b) being almost invisible in most installations; (c) being adaptable to future vehicle configuration changes, and so economies of scale can be leveraged to reduce cost because the unit continues to be easy to install even in new models with different design configurations, and also the unit can be removed from one vehicle and installed in, for example, a new replacement vehicle; (d) accommodating an efficient cellular antenna of almost any size or configuration.

It should also be understood that with the two-part embodiment of the data harvesting unit the second part 12 is not subject to size limitations and additional embodiments are contemplated where additional components or larger components with better performance characteristics may be used without making the device obtrusive.

Structural Aspects of Data Harvesting Device

As shown in for example FIG. 2*a* and also in FIG. 2*b*, in one aspect of the invention, the data harvesting device structurally includes a low profile OBD connector, which protrudes only a minimal distance from the OBD port when installed in the vehicle. This is an important design element that enables on-board installation of the data harvesting device, connected to the OBD port and intended for permanent installation. Since the OBD port in vehicles is universally located somewhere within the driver-side footwell, and typically within 12 inches of the steering column,

- Any device using a conventional OBD plug (and as is commonly implemented today), would frequently protrude sufficiently into the footwell space to impede safe operation of the vehicle in some circumstances,
- Would inhibit the closure of the OBD hatch cover in vehicles so equipped, and
- Be an extremely visible addition to the interior fitments of the vehicle, with commensurately negative impact on aesthetics and drawing attention where some applications (such as stolen vehicle tracking) require maximum invisibility.

Additionally, the position of the OBD port in the vehicle varies by manufacturer insofar as it can be located to the right, or to the left of the steering column and may be oriented in any fashion, i.e. horizontally, vertically, or at any angle in any axis. It is therefore desirable to have the cable portion of the VIC exit the plug connector in a right- or left-handed orientation, such orientation being specific to the design of any given vehicle. Therefore in another aspect of the invention, the data harvesting device is provided in a a left-handed cable assembly, FIG. 2*b*, and in a right-handed cable assembly, FIG. 2*g*.

Figure 2G:
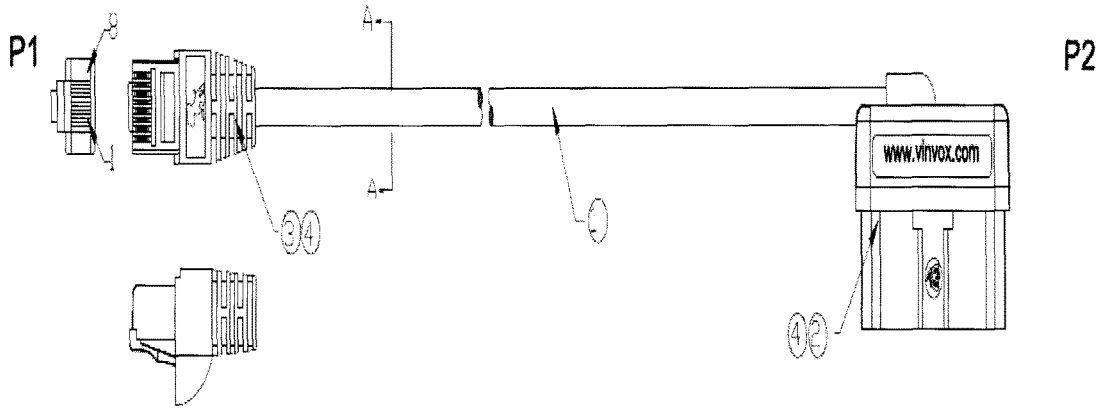
FIG. 2*g* shows a "right side" embodiment.

Another unique feature of the cable assemblies in FIGS. 2*b* and 2*g* is the termination of the cable (opposite to the OBD plug) with an RJ-45 locking connector, and equipped with a hood or fairing over the locking tab to prevent inadvertent snagging on other protrusions during installation. The use of the RJ-45 connector provides for an extremely robust connection and the pins are typically gold-plated which eliminates the risk of corrosion in the potentially moist environment of the vehicle footwell. Additionally, the RJ-45 provides excellent pin density that is far superior to the large automotive-style connectors typically used in such applications. This allows the data harvesting device to achieve a form factor that is not constrained by the size or shape of the connector itself, and is therefore be smaller than could otherwise be achieved.

Figure 6A:
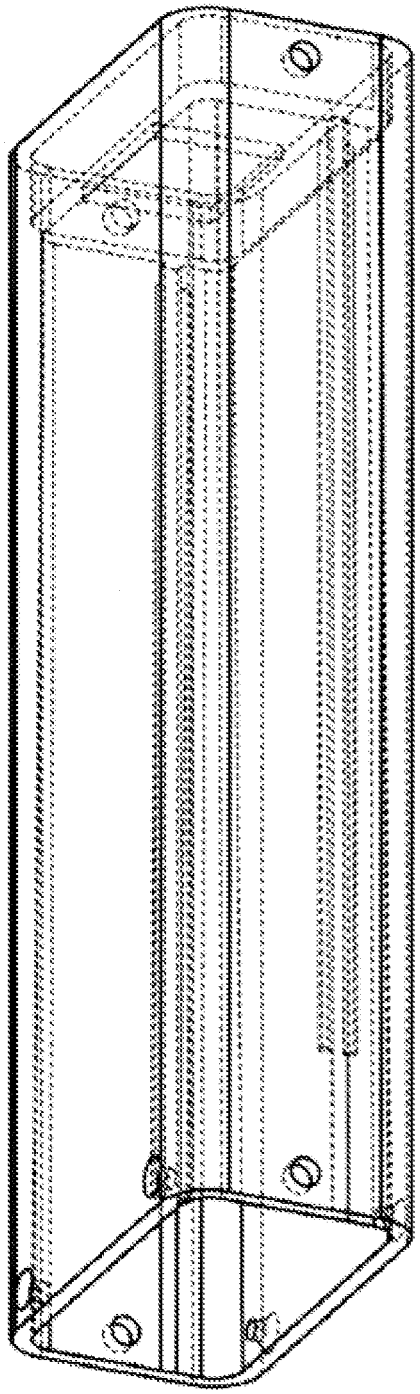
FIGS. 6*a* to 6*e* depict a representative enclosure for the data harvesting device of the present invention.
Figure 6B:
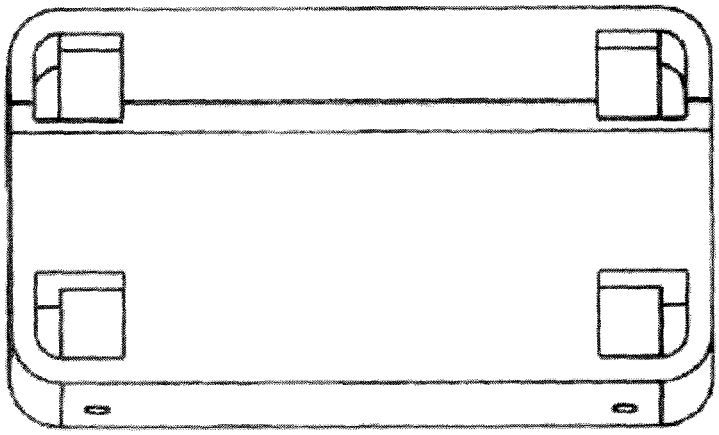
Figure 6C:
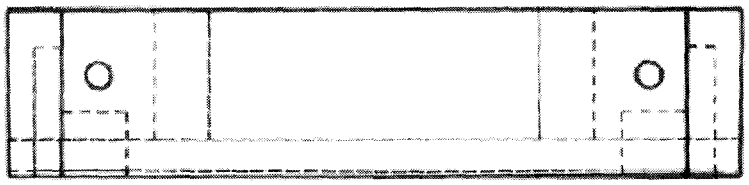
Figure 6D:
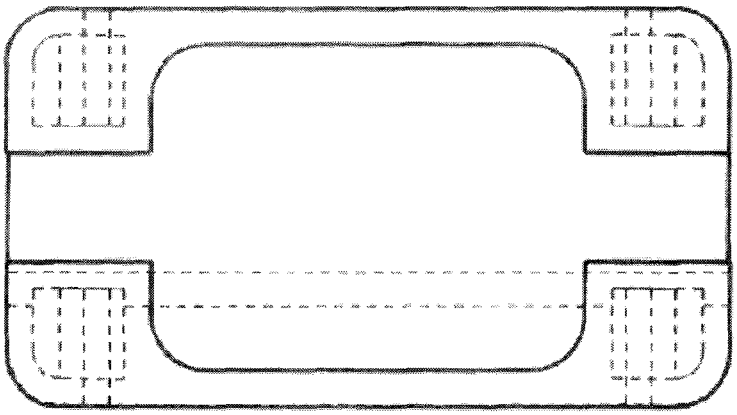
Figure 6E:
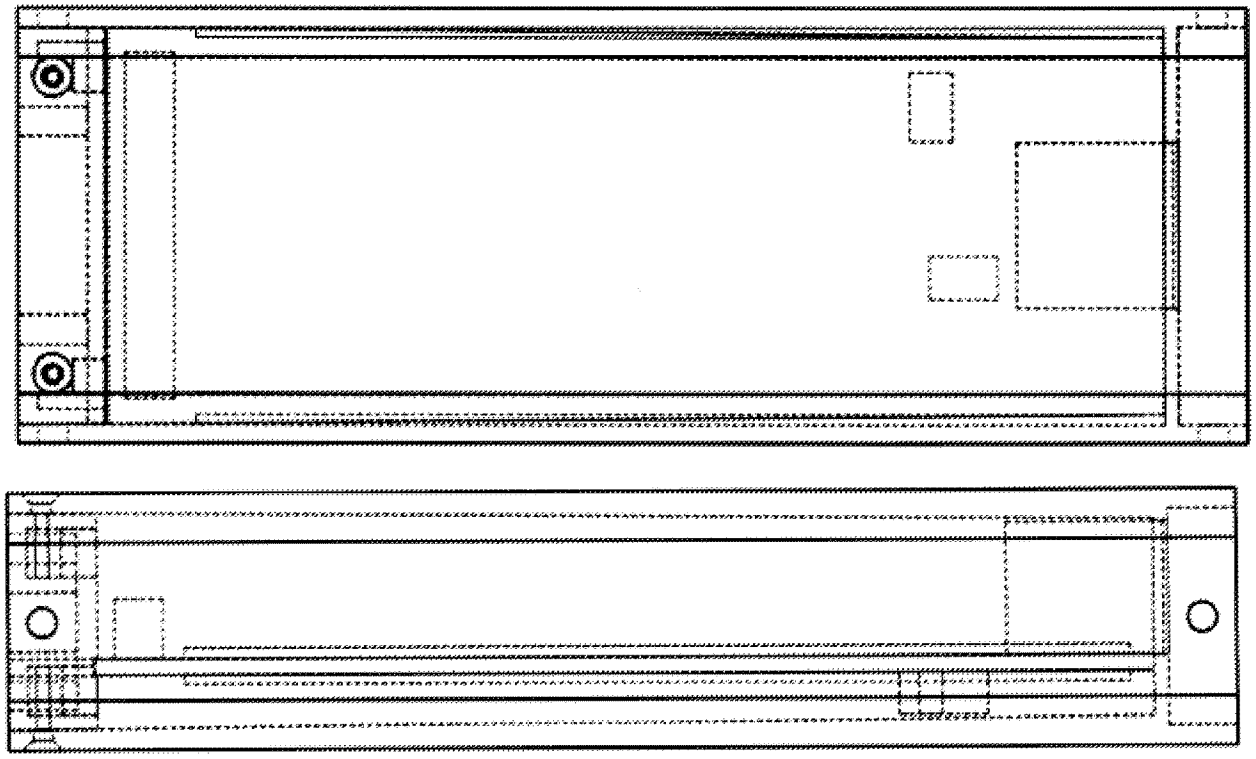

In order to protect the components of the data harvesting device, it may be desirable to use an enclosure. A representative structure for such an enclosure is shown in FIG. 6*a*.

Representative Hardware Specifications

Figure 2H:
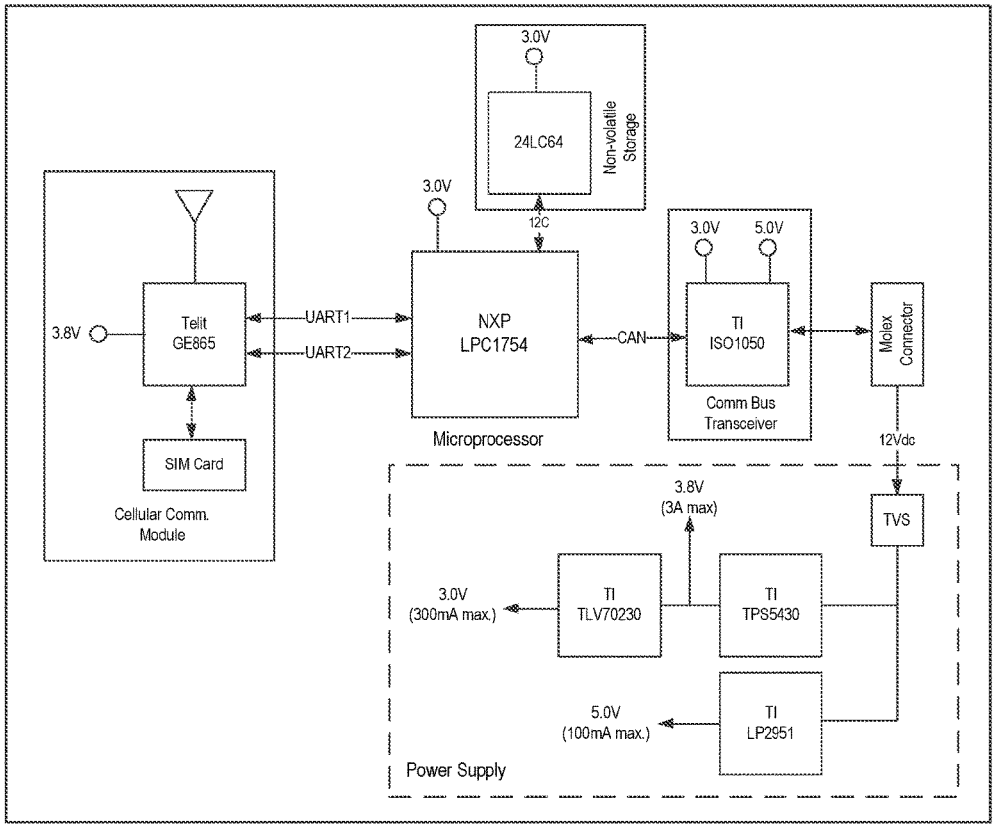
FIG. 2*h* is a circuit diagram illustrating a representative circuit implementation of the data harvesting unit in accordance with an embodiment.

The following describes a representative implementation of the two-part embodiment of the data harvesting device, referencing FIG. 2*h*, and describing certain of the hardware specifications for providing the hardware components thereof.

- The micro-computer 9 may be implemented using a single micro-controller PCB, for example a four layer PCB.
- Non-volatile memory may be used to store information and provide the data store 26 as further explained below. FIG. 2*h* illustrates the use of EEPROM or Flash memory for storing non-volatile information.
- As shown in FIG. 2*h* a micro-controller may be connected to an LED to indicate operation of the device. When the LED is "OFF" this may indicate that the device is powered down; flashing may indicate initialization; "SOLID" normal operation for first 5 minutes; and then "INFREQUENT FLASHING" which indicates that the device is in operation.
- The micro-controller runs the firmware described below.
- A CAN BUS interface may be used to connect to the OBD-II interface. In one implementation, power is supplied through this interface.
- A GSM module is included for wireless data communication connectivity. Preferably, data transfer is initiated only through GPRS.
- The GSM antenna may be arranged within the tether, as mentioned earlier.
- The device may comply with ISO 7637-2.
- The micro-controller and other components may be designed to operate in a temperature range suitable for the relatively broad range of temperature conditions that are likely within vehicles in different temperatures zones.
- The housing and components may be designed to enable the insertion of a SIM card for wireless connectivity.
- Power may be supplied to the second part 12 from the data port via the tether or cable 14. Other arrangements are possible. The cable 14 may also provide CAN bus connectivity.
- A protection circuit may be applied to protect the power supply from reverse voltage and over voltage conditions.
- A further 2×3 pin connector may be provided for programming and debugging.
- The device may incorporate a Global Positioning System (GPS) module to permit the transmission of specific location information in addition to vehicle operating data.
- The device can also incorporate for example Wi-Fi and/or Zigbee wireless communication circuitry to permit multi-mode network transmission of data and proximity detection with respect to a fixed transmitter location.

Device Computer Program Specifications

The following describes a representative implementation of the device computer program described above. In the implementation described below, the device computer program is implemented as firmware. For example, the firmware version may be written in structured C and compiled with any industry-standard compiler.

The firmware is operable to:

- Initialize the GSM module.
- Read configuration information from non-volatile memory on power up.
- Write configuration information to non-volatile memory.
- Operate the LED.
- Send and receive messages through the CAN BUS. Initiate data communication with remote host system.
- Communicate with the remote host system for the purpose of:
  - Obtaining configuration information.
  - Report collected information.

Typical Operating Behaviour for the Data Harvesting Device

Additional details regarding the data collection and telemetry functions of the data harvesting device follow. It should be understood that descriptions below illustrate possible implementations of the invention, through a representative implementation, and the present invention is not limited to this or any other particular implementation.

CAN Bus Data Polling

Upon either the Initial Data Polling/Scheduled Data Polling, the data harvesting device (referred in this section as the device) may be configured to poll for the following types of CAN Data:

Synchronous (Request/Response); and

Broadcast (Response is generated Asynchronously).

Every poll can be configured for 1-8 distinct responses. When processing the responses for a given polling set:

If a positive response is received, then the set is marked for reporting to the host.

Only positive responses are added to the marked set, any Negative Acknowledgements (NAKs) are discarded.

If a Negative Acknowledgement (NAK) is received, then it is discarded. No other action is taken.

If the device is configured to initiate a Data Notification Session with the Remote Host within 15 minutes of a scheduled CAN Poll, polling of the CAN Bus is suspended until this activity has completed. This is the default value, and a value is added to the Configuration Response to modify the duration from the Remote Host.

Message Reporting Types

Normal Frames—A positive response may be is marked to be flushed at the next scheduled Reporting Interval. If an additional positive response set is received before the Reporting Interval, it simply overwrites any previous outstanding response(s).

Differential Frames—The last positive response set is buffered. All following positive responses are compared with the last. If they are the same, no action is taken. If the new response differs, it is then stored and marked for flush at the next scheduled reporting interval.

Alarm Differential Frames—The last positive response set is buffered. All following positive responses are compared with the last. If they are all the same, no action is taken. If any of the new responses differs, they are then stored and marked for flushing immediately. The device will then initiate communications with the Remote Host to flush all Data marked for notification.

GSM/GPRS Communication

Device Date/Time

The data harvesting device initially obtains the current date/time from the GSM/GPRS Network, and subsequently re-synchronizes on every connection to the network.

Message Encryption

With the exception of the Initialization Request/Response, all messages transmitted over the GSM/GPRS network utilize a symmetric key algorithm. The specific algorithm is AES-256 ECB. The device uses a temporary key (generated with a known methodology), once the Initialization sequence is complete to encrypt the key exchange. After the key exchange is complete the device uses a host-generated key until the "key exchange required" flag is set or until the initialization process occurs again.

Device Initialization/Re-Initialization

Initialization occurs in one of two flows: either upon initial power-up of the device, or in the event of communication errors. Initialization requests are unencrypted, and the Device ID is reset to zero.

In cases of re-initialization, if the device has a valid configuration from a previous initialization session, it does not perform the Configuration Process unless the Config_Sync_Flag is set to true.

If the device performs a re-initialization, and the device identifier differs from the current one in use by the device, it discards all stored configuration parameters and initializes in the same fashion as 1$^{st}$-time initialization.

Device Configuration (Initial/Updates)

The configuration for the data harvesting device is not be maintained in power-safe memory. It is volatile, to ensure that an improperly configured device is not placed into an incompatible vehicle.

The device maintains 2 complete sets of configuration parameters:

The applied (i.e. current) configuration

The pending (i.e. downloaded) configuration

The Global configuration for the device contains the following basic information:

The CAN polling rate

The CAN polling timeout

The reporting Interval

The network TTL

The CAN message polling configuration consists of 1-8 message configuration blocks. Each block contains the following:

The message type: Broadcast/Synchronous

The request arbitration ID

The request frame data

The response processing type, which determines how to proceed when a positive response is identified, i.e.:

Normal

Differential

Alarm Differential

The response arbitration ID(s)—1 to 8

Masking data. The response must contain masking data to considered positive and consists of:

An offset to begin applying mask data

The mask data Length

The mask data

In the event of re-configuration:

All Message Polling operations are suspended while the device is performing the re-configuration process.

The device places all new configuration information into the pending configuration buffer, and does not apply the new parameters until the process is complete.

Data Notification

This occurs in the following cases: initialization, scheduled, or immediately. Whenever it is triggered, all marked data is sent to the remote host using the data notification procedure.

Once the marked data has been successfully flushed (i.e.: an associated data confirmation for the data notification has been received), the "flush" flag is cleared.

If the vehicle is not active (i.e.: is turned off) when a scheduled data notification occurs, it does not establish communication with the network. It should wait until the vehicle is started and then execute the missed Data Notification.

Errors on the GPRS/GSM Data Network

If the device is currently in a data session with the remote host, and loses connectivity due to lost signal, it performs as follows:

If performing a 1$^{st}$-time configuration, it re-establishes communication with the GPRS/GSM network until it is able to connect and continue the configuration process If executing a transmission at a regular reporting interval, it waits until the next scheduled reporting interval to re-attempt connecting to the network.

If re-configuring the device, it rolls back to the previous configuration version and waits until the next scheduled reporting interval to re-attempt the configuration process.

Device Sleep Mode

When not actively performing any processing or communication activities, the device enters a low-power state and does not exit this state until the next scheduled activity.

When the device exits a sleep state, it determines whether the vehicle is active before message polling occurs, or data is reported to the remote host. If not, it re-enters the sleep state and waits for the next scheduled event before exiting the sleep state again.

1st-Time Initialization of Device

1. Determine the CAN Bus Speed
   - While this can be either 250 kB/500 kB under SAE j1979 specifications, it can only be 500 kB for North American vehicles (as mandated by C.A.R.B.)
   - Determine whether CAN ARB IDs are 11-bit/29-bit
     - If an 11-bit request does not succeed, attempt a 29-bit request
   - Determine whether the CAN Bus is active
     - Use Mode 1—PID 0 for this functionality(active) or pin-sniffing (for passive)
2. Request VIN from vehicle
   - Request (0×7DF)—02 09 02 00 00 00 00 00
   - Alternatively, use Mode 9 PID 00 to determine support for PID 02 (if required)
   - If Mode 9 PID 00 does not notify properly, cycle thru 0×7DF-0×7E7
   - Requests are sent until a response is received; otherwise it cannot proceed beyond this point
   - Retry every 3 seconds until successful
3. Once the VIN is Retrieved, the Device:
   - Initializes the GSM/GPRS Module for communications
   - Registers on the GSM/GPRS Network
   - If errors are encountered, the device retries in 15 seconds
   - Requests the ICCID from the GSM/GPRS Module
   - Synchronizes the device time with GSM network
   - Opens a socket connection to the server
   - Sends an initialization request (unencrypted), using the retrieved VIN and ICCID
   - If an initialization response is not received due to:
     - Timeout: the device retries in 15 seconds
     - NAK: the device retries in 15 Seconds
4. The Initialization Response is Encrypted Using PKO
   - Upon receipt of the response, the following data is validated:
     - Matching data link &initialization response device IDs
     - Matching initialization response VIN and (originating) vehicle VIN
   - If there are any dissimilarities, the initialization request is repeated
   - The server-assigned device ID is stored and all subsequent communications include this ID and are encrypted (except for follow-on re-initialization requests
   - The device enters a configuration mode and sends a configuration request to the server
5. The Configuration Flow Process
   - The device enters the configuration mode:
     - Store the sessionID
     - Start a session countdown timer (TTL)
     - Send a configuration request using the sessionID
   - The configuration response is processed:
     - Confirm that the session ID matches the buffered sessionID
     - If not successful, discard the response and re-initialize
     - If successful, the following data elements are stored:
       - The CANnetwork polling rate
       - The CAN network polling timeout
       - The device reporting interval
       - The network countdown timer (TTL)
     - All CAN configuration blocks are stored
     - If the configuration is valid then the device exits configuration mode
     - The current session ID is set to the buffered sessionID
     - The "Applied" flag is set
     - The configuration is marked as active (no longer pending)

If any errors are encountered during the initialization and configuration of a previously unconfigured device, the failed commands for the initialization or configuration are resent 3 times. Should the process fail after the third attempt, it is completely restarted from the point of polling for the vehicle VIN.

Data Polling

Using the new configuration and at the specified intervals, the device polls for CAN request/response pairs. Polls are processed in an incremental order, and the next poll is not attempted until the previous one has received either successful response (not necessarily positive), or a timeout has occurred. The device identifies Negative Acknowledgements (NAKs) and does not mark these for transmission to the host. Once all configured messages have been polled, the device determines whether there are any messages to report to the host. If so, it will initiate a data notification session with the remote host to report all accumulated data.

Data Notification

Once the data polling is complete, the device initiates a Data Notification to the Remote Host to report the values retrieved. This activity happens both upon 1st-time configuration of the device, as well as any subsequent re-configurations of the device. Once the device initialization has been completed, the configuration values for CAN polling rate and reporting interval are used to determine when the next activity will occur.

Data Confirmation

Once all pending data has been flushed, the device disconnects from the remote host and powers down the cellular communications module to conserve power.

Re-Initialization

If the device must perform a re-initialization with the remote host due to any error condition, and encounters the situation where the initialization response contains an identifier that does not match the current device ID:

- All unflushed records are discarded
- All configuration parameters are discarded, and the device reverts to an unconfigured state
- It then re-initializes as if plugged into the vehicle for the 1st time.

Typical Data Notification Exceptions

1. If a scheduled reporting interval is reached, and there is no data to flush, the device does not initiate a connection to the remote host.
2. If the vehicle is turned off when the scheduled reporting interval is reached, the data is still be transmitted. In cases where the vehicle is inactive for long durations of time, it will flush the last data accumulated to the remote host, and then there will be no further data to send.
3. If consistent errors are encountered during data notification to the remote host (activated by either a scheduled or immediate action), the device waits until the next scheduled reporting interval to send the records to the remote host.
4. If the device is forced to re-initialize, it discards all unflushed records and re-configures.

Negative Acknowledgements (NAKs)

All NAKs are sent from the remote host to the device as unencrypted data. If the device receives an encrypted NAK, it considers it a protocol error comparable to a corrupted message.

If a NAK is received, the originating request is re-tried a maximum of 2 times. At this point, processing continues according to defined flows.

Master Kill

Master Kill is a feature that allows the remote host to cause the device to disable itself in a power-safe manner, so that it cannot be restarted unless returned to the manufacturer. There are two paths of protocol execution for this to occur: the Initialization response and data confirmation both contain a "Master Kill" flag. If the device receives either message with this flag set, it performs the following actions:

A Master Kill request is sent to the to the remote host

Upon Receipt of a Master Kill response, a flag is written to a power-safe block of memory indicating that the device should disable itself.

The device powers down.

Upon any subsequent power-up, the device firmware checks this power-safe block of memory to determine whether the Master Kill flag had been set. If so, it immediately shuts down.

Further Details Regarding System Implementation

The overall system includes one or more data harvesting devices, and one or more remote servers that interoperate with the data harvesting devices. One possible implementation of the system of the present invention is illustrated in FIG. 3.

The various data harvesting devices 62 that log and transfer the vehicle operation data for the vehicles 60 are configured to communicate with one or more remote servers 64.

Figure 3:
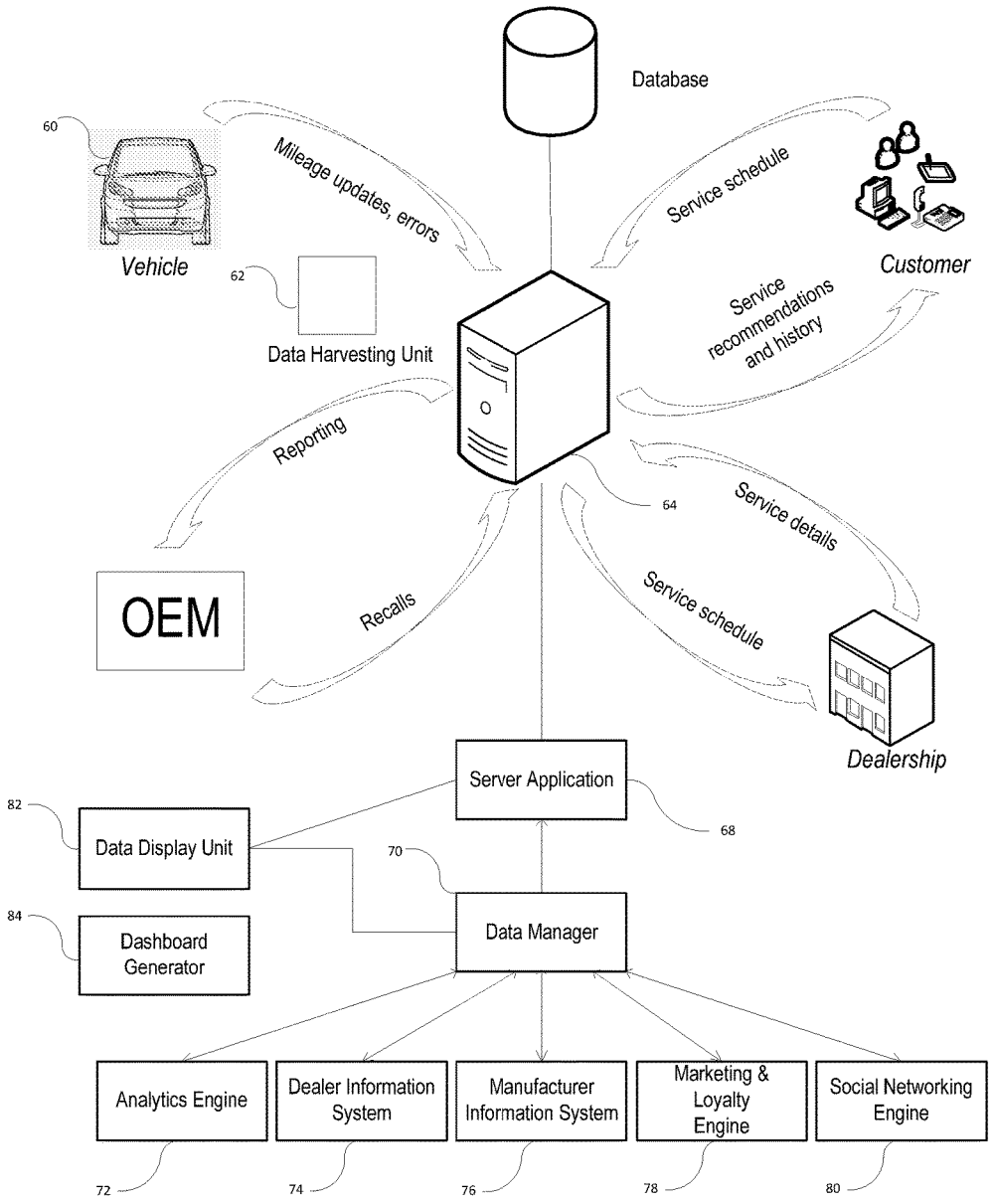
FIG. 3 is a system diagram illustrating a representative embodiment of the system.
Figure 4A:
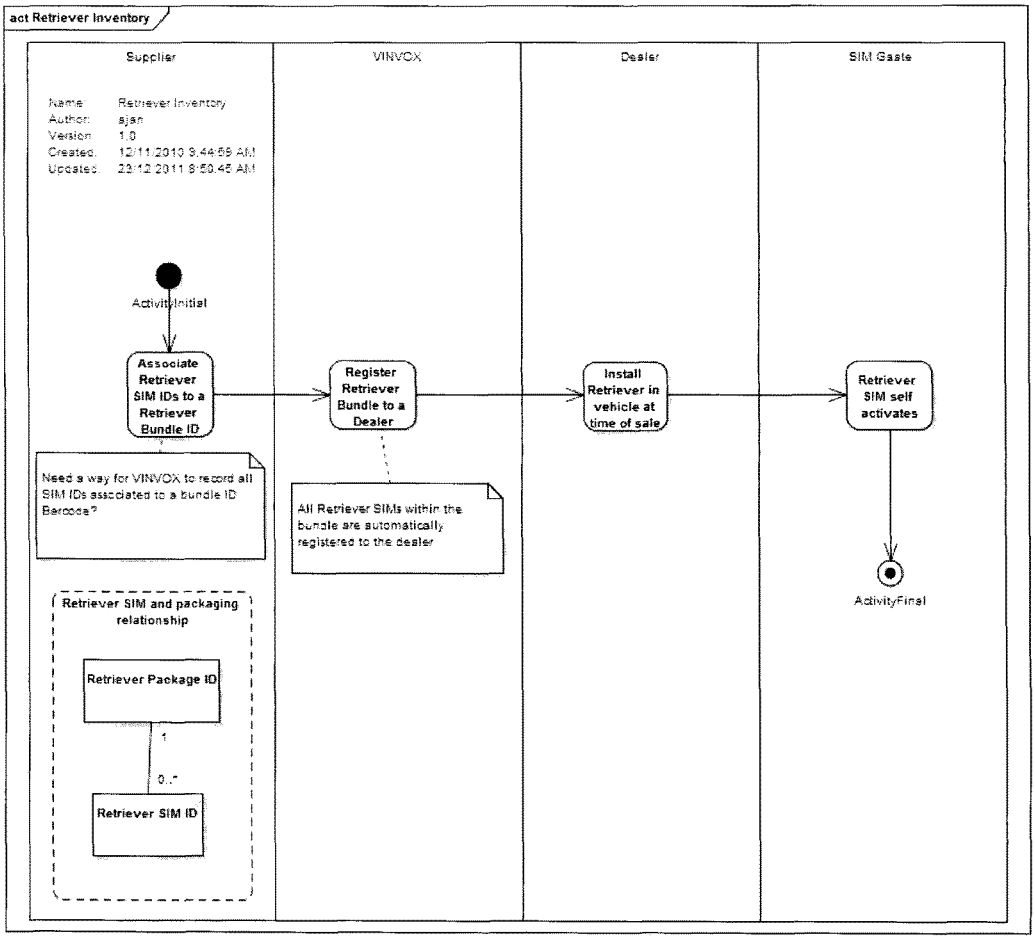
FIGS. 4*a* to 4*d* are a series of workflow diagrams illustrating the operations of the device in accordance with an embodiment.
Figure 4B:
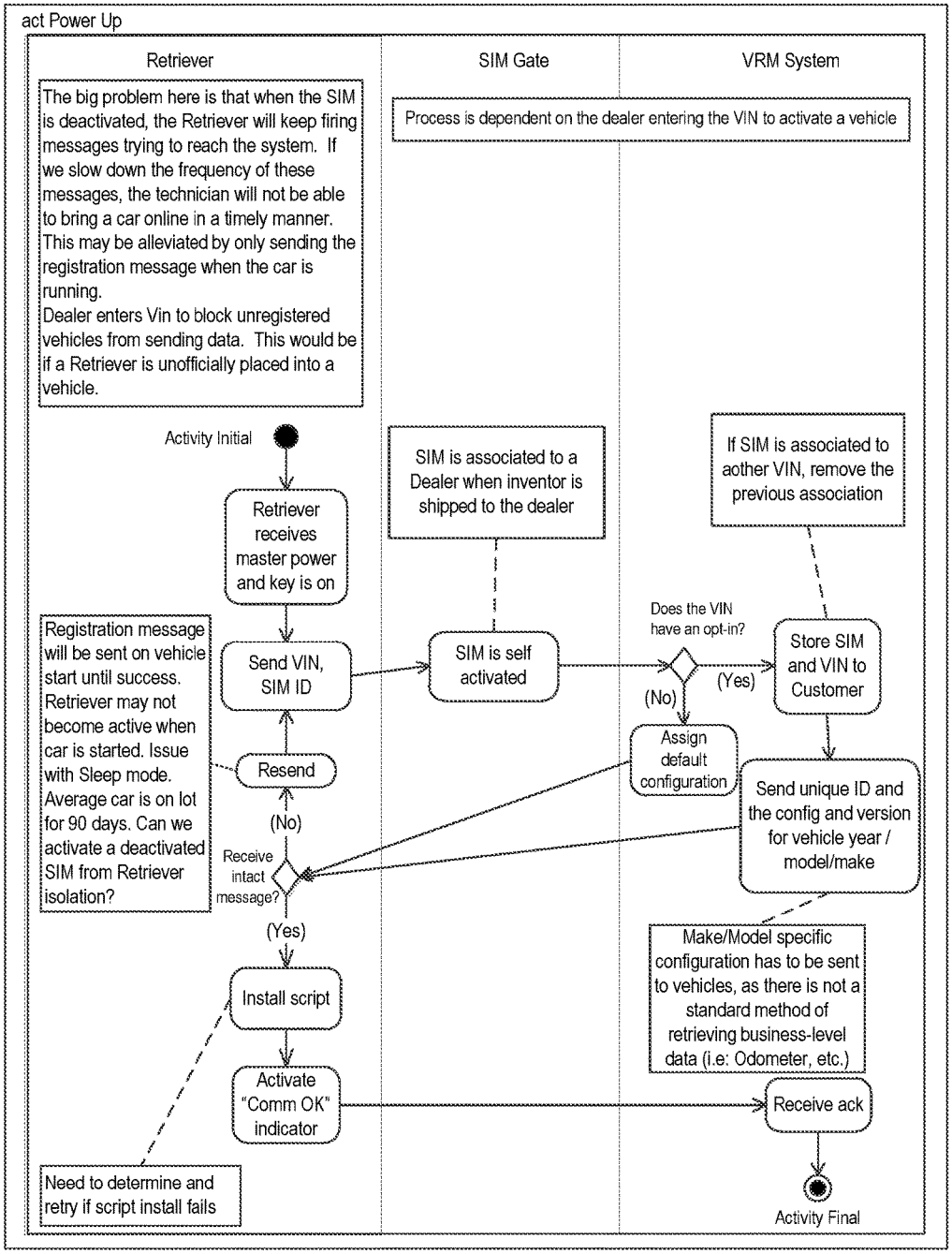
Figure 4C:
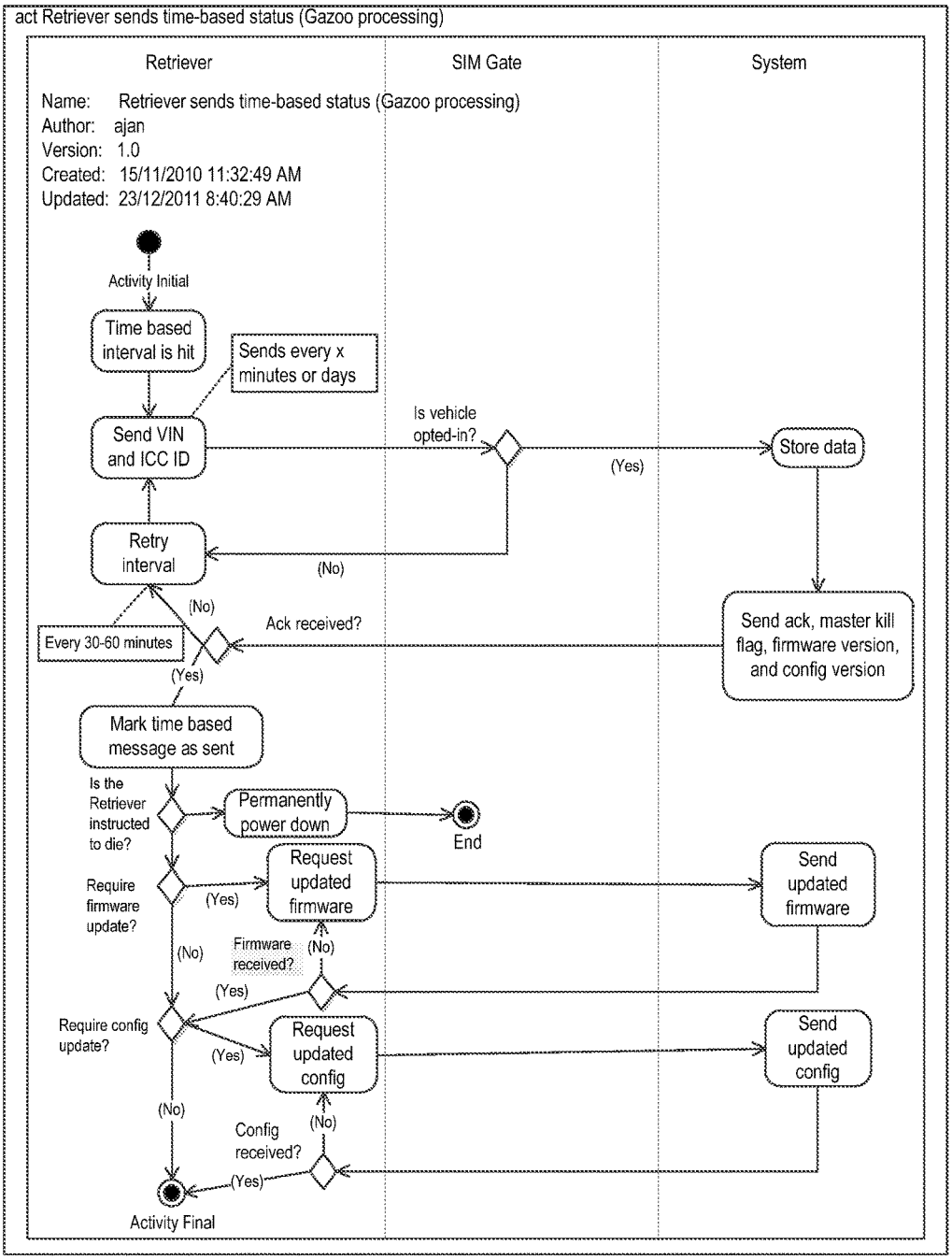
Figure 4D:
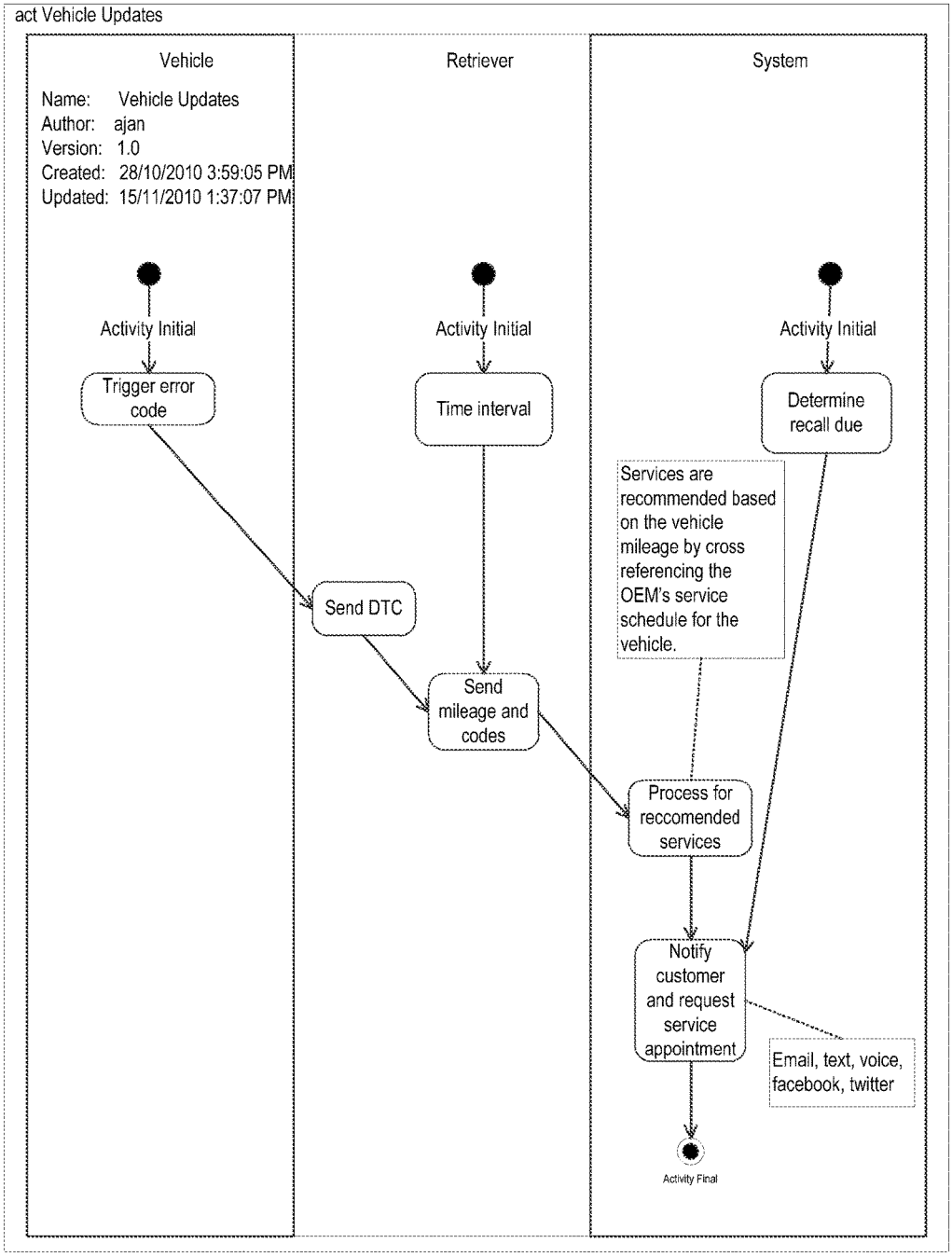

As best illustrated in FIG. 3, the remote server 64 includes a server application 68 which may consist of an application repository. As mentioned again below, it should be understood that the network architecture illustrated in FIG. 3 can be modified using any suitable networking arrangement, including implementation of the resources described using a cloud computing or distributed architecture.

The remote server 64 is linked to a database or data centre that is operable to store the data from the various data harvesting devices, as well as the various additional data based on enhancement of the data from the various data harvesting devices The server application 68 may include a suitable administration utility (not shown) that manages access to the contents of the data centre, and the various resources made accessible through the server 64 on a permissions basis. For example, the administration utility ensures that:

Manufacturers only access data for their vehicles, or their dealers, as is predetermined.

Dealers access only data for which they are authorized such as vehicle operation data for vehicles sold by them, or for vehicle owners that have agreed to their vehicle operation data.

Vehicle owners only access data for their vehicles, or data for other vehicles based on consent from the other vehicle owners.

Trend data based on underlying aggregated vehicle operation data based on permissions or payment of fees such as subscription fees.

Derivative data such as enhanced data using analytics or reports may only be made accessible to subscribers for such information.

Various other access conditions are contemplated, whether to comply with permissions, user preferences, privacy laws or otherwise, or to address additional functionality described below.

The various functions and data linked to the server 64 may be made available to users, based on access established using the administration utility, via a web interface presented by the server 64, which provides access to a series of web pages that enable navigation through the functions and presentment of accessible data.

In one particular implementation, the operator of the server 64 is provided an Access Point Name (APN) by one or more wireless carriers, which acts as a unique identifier on the applicable wireless network, and enables the various communications from the data harvesting devices to be received by the server 64, the various devices using the APN only, and for billing for data services to be integrated with other billing functions that may be associated with the server 64.

The various data harvesting devices 62 are operable to assemble a message that includes the VIN, and one or more vehicle operation data parameters, and send the message on a wireless basis to the server 64. It should be understood that in one aspect, the data harvesting devices 62 are designed such that they are able only to push information and therefore are not vulnerable to security attacks. This limits the ability to remotely modify their programming but in this case updates can be distributed differently, for example, providing additional configuration data via a suitable data port. In situations requiring initiation of transactions from a remote location, or remote reprogramming of the device firmware, or otherwise involving the transmission of potentially sensitive information such as GPS coordinates, the device is capable of and will implement a standard symmetric-key encryption algorithm such as DES or AES. The use of the VIN number in the communications also protects the privacy of the vehicle owners as any third party intercepting the communications is unlikely to have access to this information and therefore a connection between the message and activities of a person cannot be made. In addition, the VIN is only used as the primary identifier during initial configuration of the data harvesting device, during which time a unique and random device ID is assigned by a remote application server. Subsequent communications use this random ID which is only associated with a vehicle within the system database and is not otherwise discoverable.

The server 64 is operable to retrieve the VIN from the messages and look up the VIN from a library in the data centre to identify the associated profile and data section in the data centre. The associated profile determines the rules for processing and providing access to the vehicle operation data in the message or aggregated vehicle operation data across multiple messages.

At the very least, leveraging the data manager 70, the server 64 acts as an information gateway or router, routing information based on stakeholder defined rules (subject to permissions) by sending vehicle operation data in the desired form to the desired locations, whether this is to remote computers and/or applications associated with these computers controlled by manufacturers, dealers, or vehicle owners.

As illustrated in FIG. 3, the server 64 and its various resources, leveraging the vehicle operation data, operable to act as a resource to a variety of stakeholders, enabling a range of operations such as maintenance reminders, service scheduling, vehicle owners obtaining up to date "vehicle health" information and sharing this with others, vehicle health dependent information (such as specific materials or recommendations) being pushed to vehicle owners, reporting to manufacturers to aid in product recall and vehicle marketing and loyalty operations and so on.

A number of these operations may be provided using a network architecture where server 64 acts as an information resource for example to a dealer's dealer information system, or a manufacturer's marketing system or loyalty engine. Alternatively, and as shown, in FIG. 3, the operator of the server 64 may support these operations by deploying a variety of systems within its own environment, which are operable, for example based on a SaaS model to provide a range of web services to manufacturers, dealers and others.

The server application 68 may include an analytics engine 72 which is operable to enhance the vehicle operation data using a variety of data mining and data modeling tools or techniques for example to predict maintenance requirements, identify vehicle performance trends, infer vehicle purchase trends and the like. The analytics engine may employ the vehicle operation data and other data made accessible to the server 64 such as communications and interactions by vehicle owners or between vehicle owner groups facilitated by operation of the social networking environment described below. The analytics engine 72 is operable to feed enhanced data to the other resources of the server application 68. The analytics engine 72 may be linked to a reporting utility that is operable to create a series of reports, including based on preferences of the recipient of such reports (whether for example the manufacturer or the dealer). The presentment of such reports, if made accessible via one or more web pages, can be enhanced by operation of the data display utility 82 for example including dealer or manufacturer specific branding, as appropriate, or other web presentment preferences.

Many dealers have their own dealer information system, in which case the server application 68 may be configured to interoperate with such dealer information systems for example to provide an enhanced maintenance reminder and scheduling system. Currently most dealer information systems or systems linked to these, send reminders to customers based on approximate or anticipated mileage. The dealer has an interest in ensuring that these reminders are acted on as much as possible, but the reminders are often ignored in part because there is a disconnect between the need for a scheduled maintenance which is based on actual mileage readings and the estimated mileage reading used by the dealers. In other words, the customer is most likely to book the service appointment if the reminder is just in time, and customers who are busy and overwhelmed with electronic communications as it is, are quite likely to ignore reminder that is sent too early or too late. Alternatively, repeated reminders which are common in part to address the lack of access to accurate odometer information using prior art technologies can be quite annoying to vehicle owners, which in turn can diminish the value associated with a brand. Conversely, a maintenance reminder received by a vehicle owner at the right time and once or twice will result in a better response rate and also will enhance the customer's brand experience.

The better response rate also allows the dealers to manage their maintenance related human resources better. A reminder with improved relevance, and which is more likely to be responded to, can be sent with a few proposed maintenance times, sent such that times will be left open for a predetermined amount of time. This reduces the time required by customers to book their appointments, and also reduces the costs involved in taking bookings. The customers are also provided an enhanced service. The operations described can be used to better utilize maintenance related human resources. Overall, the ability of the system to initiate transactions between the dealer or OEM and the vehicle owner based on actual operational data and then only when appropriate, and allowing that vehicle owner to take necessary or desired actions with an absolute minimum of effort or diversion through optimized workflows and man-machine interfaces, will directly engender loyalty and hence persistence in dealer-customer relationships.

In addition, incentives can be attached to filling gaps in schedules using a scheduling utility that relies on the enhanced information provided using vehicle operation data provided by operation of the present system and method.

The data manager 70 can be used to map data to integrate with the dealer's scheduling systems, whether part of their dealer information system or otherwise.

Alternatively, the server application 68 includes a dealer information system 74 that enables the dealer's personnel, using a web interface, to utilize functionality similar to dealer information systems made available through a series of web pages, and accessing improved scheduling operations for example that leverage the access to vehicle operation data.

Similarly, the data manager 70 can provide access selected data to a manufacturer's information system that is used to manage product recalls, identify product trends including based on in the field vehicle operation data. An example of data that could be routed to a manufacturer by operation of the present system is a trouble code related to a vehicle made by that manufacturer. The present system and method enables access to more granular vehicle operation data on a more timely basis, enabling the manufacturer to identify and rectify, or at least manage public response to a problem, before the problem or public reaction to it gets out of control. Prior art technology provides access to this data only based on vehicles brought into dealerships either for scheduled maintenance or for based on a problem that has already been noticed by a vehicle owner. The present system and method enables much more proactive management of performance issues, and also better management of brand experience.

Alternatively, the server application 68 includes a manufacturer information system 76 that enables the manufacturer's personnel, using a web interface, to utilize functionality similar to manufacturer information systems made available through a series of web pages, and to access improved product and market intelligence based on the vehicle operation data made available by operation of the present system and method, and leveraging other resources as well such as the analytics engine 72.

While integration of data made available via the server 64 with marketing or loyalty systems of manufacturers or dealers or their service providers is possible, dealers and manufacturers may also access marketing and loyalty services and offerings via the operator of the present system and method. The server application 68 includes a marketing and loyalty engine 78 which may incorporate a series of known marketing and loyalty resources that leverage the vehicle operation data made available by operation of the present system and method.

The present system may enable specific features, for example, surveys, incentive communications, data mining and other features, including leveraging the analytics engine 72.

Extraction of Non-Standardized Data from Internal Vehicle/Automotive Network

As described above, OBD-II provides a standard set of information about the vehicle. However, the standard set of information is not comprehensive in its scope.

Many vehicles now have low-level electronic signaling protocol, which may be a manufacturer-specific protocol, but which additionally support the ISO 15765 CAN protocol as a compulsory standard for all North American vehicles manufactured since 2008. Manufacturers are not required to disclose the position or format of discrete information on their own proprietary busses, or the standard CAN bus. Therefore, certain key parameters such as the odometer value remain generally inaccessible using the low-level signaling layer.

To address these limitations, the present invention may implement certain systems and methods for extracting information from both the proprietary and non-proprietary busses of an internal automotive network, as will be described in further detail below.

Thus, more generally, the above described embodiments illustrate systems and methods for extracting vehicle operation data from an internal automotive network, comprising: i) obtaining data available on the internal automotive network via iterative interrogation; ii) analyzing the obtained data to identify a set of candidate data values having at least one common feature within a suitable proximity margin; and iii) heuristically selecting a candidate data value best matching one or more selection criteria to identify a true value.

These systems and methods may be implemented using a hardware unit, such as the illustrative data harvesting unit as described above, connected to the standard on-board OBD connector of the vehicle, or by means of a physical connection at any other point on the internal automotive network interconnecting multiple ECUs. In addition to other supporting electronic components, this data harvesting unit may incorporate:

a) One or more bus interfaces to gain access to the low-level electronic signaling layers;
b) A microprocessor to control the interrogation, storage, transmission and application of vehicle information;
c) A cellular communication module and antenna;
d) Optionally, an additional Wi-Fi or Zigbee transceiver module and antenna for short-range wireless communication.

Heuristic Systems and Methods for Extraction of Vehicle Bus Information

The following illustrative embodiments, systems and methods are described in the context of retrieving vehicle odometer information, but identical or similar approaches may be used to extract any information carried on the internal vehicle busses, whether proprietary or non-proprietary. Each of the illustrative methods may be used individually or in combination, as necessary or appropriate.

1. Semi-Autonomous System and Method Using Known Base State

In a first example, the base state of the vehicle, i.e. the actual odometer value, is recorded and stored (e.g. in memory or storage on a remote system) by means of reading the odometer display on the instrument cluster and keying it into a computerized interface that stores the value in a database. The odometer record is matched to the Vehicle Identification Number (VIN) of the vehicle by manually entering it alongside the odometer value, or by selecting an identification record previously created for the specific data harvesting unit/module installed in the vehicle.

Incremental distance traveled by the vehicle is readily available through the standard OBD-II protocol by using the documented Mode 1 of the protocol and interrogating parameter ID (PID) 31. This yields the distance traveled since any pending diagnostic trouble codes were reset and increments in lockstep with the odometer value. Incremental changes in this value, which may be monitored continuously and added to the base odometer value previously recorded, provides the correct odometer reading at any point in time. However, an interruption in the connection of the data harvesting unit can cause a misalignment of data and so it may be still necessary to locate the specific source of the vehicle odometer value using the appropriate low-level signalling protocol.

Figure 5A:
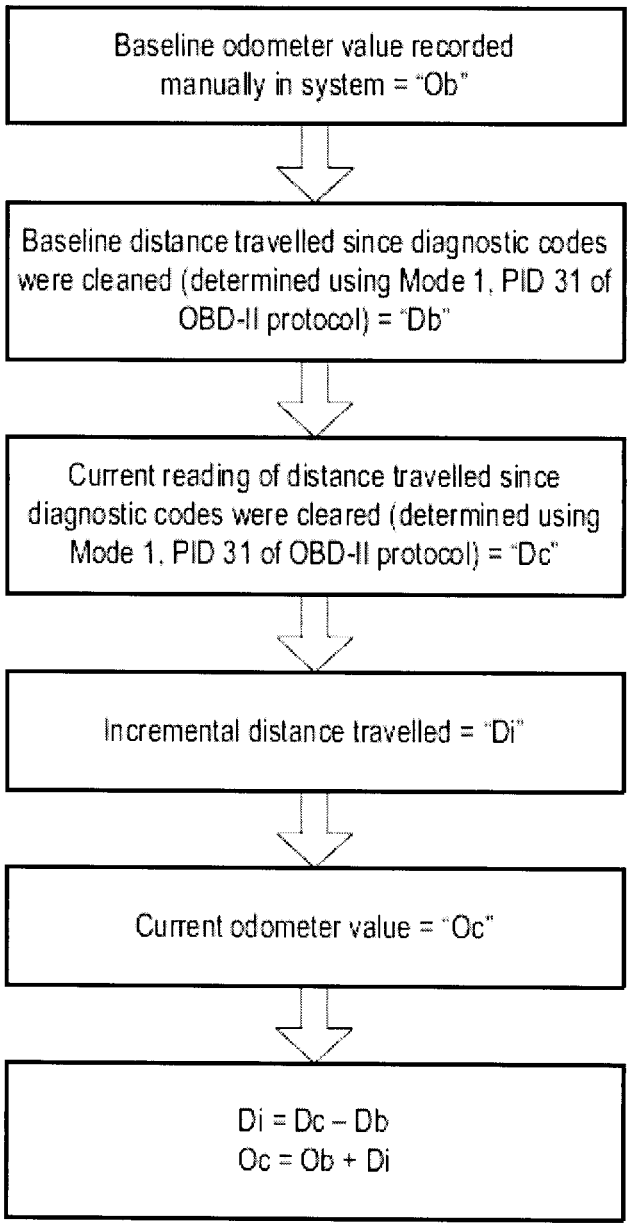
FIGS. 5*a*, 5*b*, and 5*c* illustrate representative data harvesting workflows enabled by the invention.

In this first example, as illustrated in FIG. 5*a*, the approach may be as follows:

a) The baseline odometer value recorded manually in the system is "Ob";
b) The baseline distance travelled since diagnostic codes were cleared (determined using Mode 1, PID 31 of the OBD-II protocol) is "Db";
c) The current reading of the distance travelled since diagnostic codes were cleared (determined using Mode 1, PID 31 of the OBD-II protocol) is "Dc";
d) The incremental distance travelled is "Di"
e) The current odometer value is "Oc"

Now, therefore:

a) Di=Dc−Db
b) Oc=Ob+Di

The firmware of the data harvesting unit or module uses the value of Oc as a reference for structured searches of the low-level data stream. This may include interrogation of the bus for a list of device-specific arbitration identifiers and iterative interrogation of individual devices on the automotive network using those identifiers. The result sets returned by the network using this approach are then scanned for instance(s) of Oc. A suitable proximity margin such as +/−1 in the value measured against Oc may also be applied depending on the scan rates supported by the microprocessor.

When the source odometer value is located, the data location, offsets, field size, etc. are noted and used directly for subsequent readings of the odometer value. These parameters are also transmitted to the remote system using a cellular network and matched against the VIN of the vehicle. This results in a match of the odometer retrieval parameters against the specific make and model of the vehicle, allowing direct reading of the odometer for identical makes/models without further analysis or detailed scanning. Since the information is stored centrally, it can be accessed by the data harvesting modules whenever they are installed and initialized. If a matching make/model record is found in the database, the odometer retrieval parameters may then be downloaded directly and put into effect.

2. Fully Autonomous

In a second example, a data harvesting unit/module is installed in the vehicle and evaluates multiple numerical patterns in the low-level data stream to select potential candidates for the actual odometer reading. Supplemental criteria are then used to identify the correct candidate, as well as the corresponding data parameters pointing to its position.

As before, incremental distance traveled by the vehicle is readily available through the standard OBD-II protocol by using the documented Mode 1 of the protocol and interrogating parameter ID (PID) 31. This yields the distance travelled since any pending diagnostic trouble codes were reset and increments in lockstep with the odometer value. Incremental changes in this value are monitored continuously.

Figure 5B:
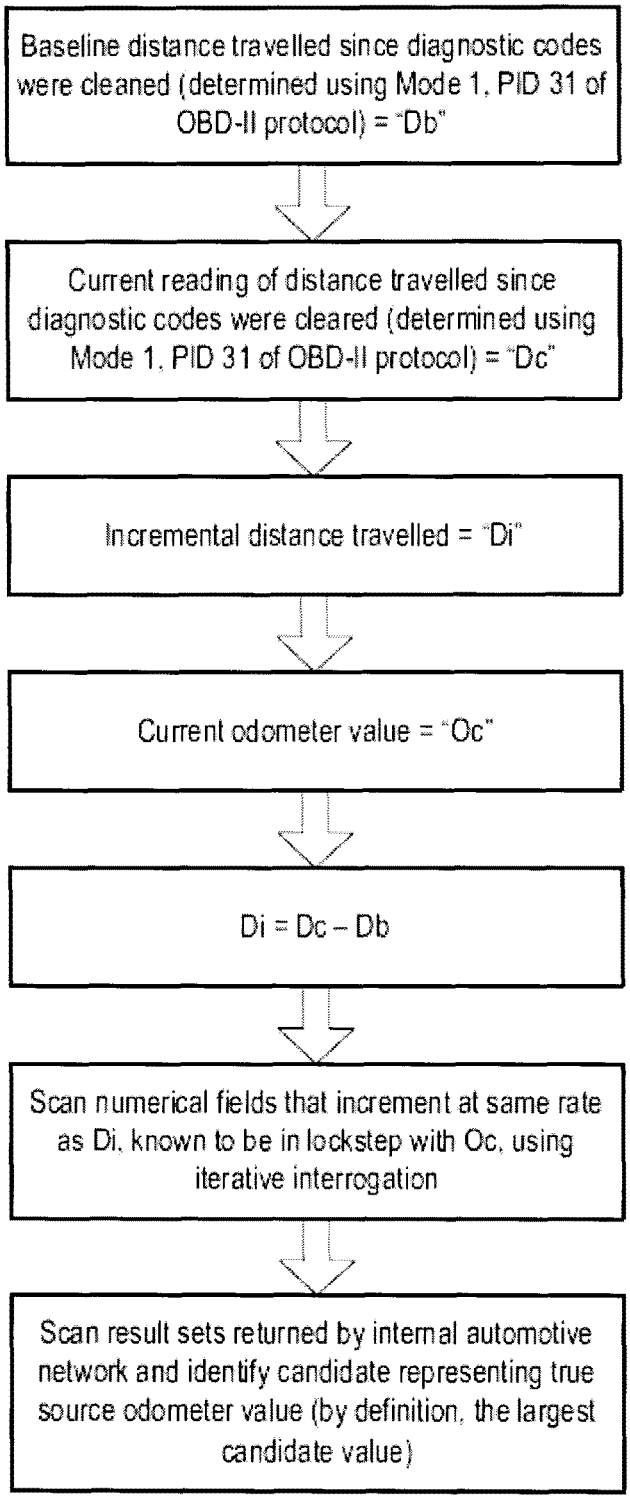

Based on this second example, as illustrated in FIG. 5*b*, the approach is as follows:

a) The baseline distance traveled since diagnostic codes were cleared (determined using Mode 1, PID 31 of the OBD-II protocol) is "Db";

b) The current reading of the distance traveled since diagnostic codes were cleared (determined using Mode 1, PID 31 of the OBD-II protocol) is "Dc";

c) The incremental distance traveled is "Di"

d) The current odometer value is "Oc"

Now, therefore:

a) Di=Dc−Db

The firmware of the data harvesting unit/module scans for numerical fields or data values having at least one common feature. In the present example, the data harvesting unit/module scans for data values having a common feature that they increment at the same rate as Di, which is known to be in lockstep with Oc. This may include interrogation of the bus for a list of device-specific arbitration identifiers and iterative interrogation of individual devices on the automotive network using those identifiers. The result sets returned by the network using this approach are then scanned for instance(s) of odometer candidate values that increment at the same synchronous rate as Di. A suitable proximity margin—such as +/−1 in the value measured against Oc—may also be applied depending on the scan rates supported by the microprocessor.

A comprehensive set of candidate values may represent such things as the trip odometer data value(s) or other distance-related data values. In dependence upon one or more selection criteria, a candidate data value best matching one or more selection criteria may be selected to identify a true value. In the present example, the applicable selection criterion would be to select the largest candidate data value of the candidate data values, as by definition the true source odometer value would be the largest of the data values that increment at the same synchronous rate as Di.

Once the true source odometer value is located in this manner, the data location, offsets, field size, etc. are noted and used directly for subsequent readings of the odometer value. These parameters are also transmitted to the remote system using the cellular network along with the VIN of the vehicle, readily acquired using the OBD-II protocol (Mode 9, PID 2). This results in a match of the odometer retrieval parameters against the specific make and model of the vehicle, allowing direct reading of the odometer for identical makes/models without further analysis or detailed scanning. Since the information is stored centrally, it can be accessed by data retrieval modules whenever they are installed and initialized. If a matching make/model record is found in the database, the odometer retrieval parameters may then be downloaded directly and put into effect.

3. Manually Verified

Figure 5C:
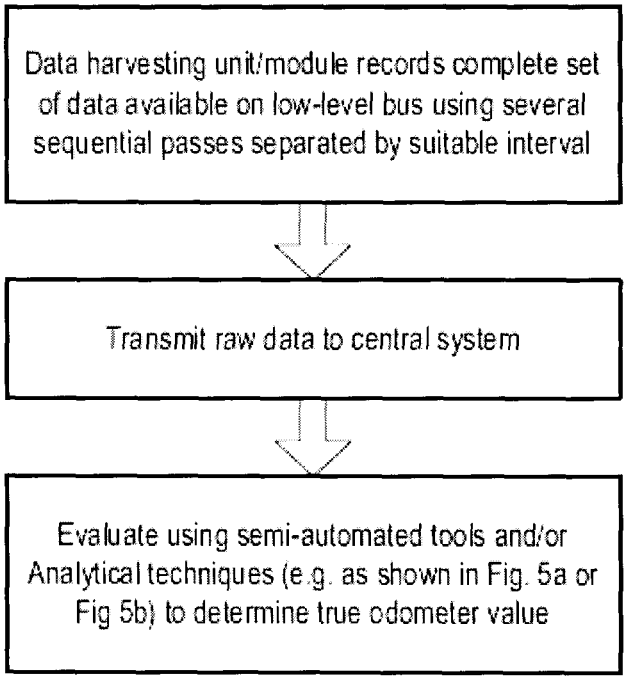

In a third example, as illustrated in FIG. 5*c*, data harvesting unit/module is installed in the vehicle and uses retrieval parameters specific to the vehicle model to locate and transmit the data at these locations back to the server application. These retrieval parameters are discovered prior to installing the data harvester in the vehicle by using a tool to read data from each vehicle model, locating the addresses of the desired data and creating a configuration of these retrieval parameters for the vehicle model. Once this is established, the retrieval parameters are downloaded to the data harvester unit/module of t connected vehicles of that make/model.

Thus, more generally, the above described embodiments illustrate systems and methods for extracting vehicle operation data from an internal automotive network, comprising: i) obtaining data available on the internal automotive network via iterative interrogation; ii) analyzing the obtained data to identify a set of candidate data values having at least one common feature within a suitable proximity margin; and iii) heuristically selecting a candidate data value best matching one or more selection criteria to identify a true value.

Figure 7A:
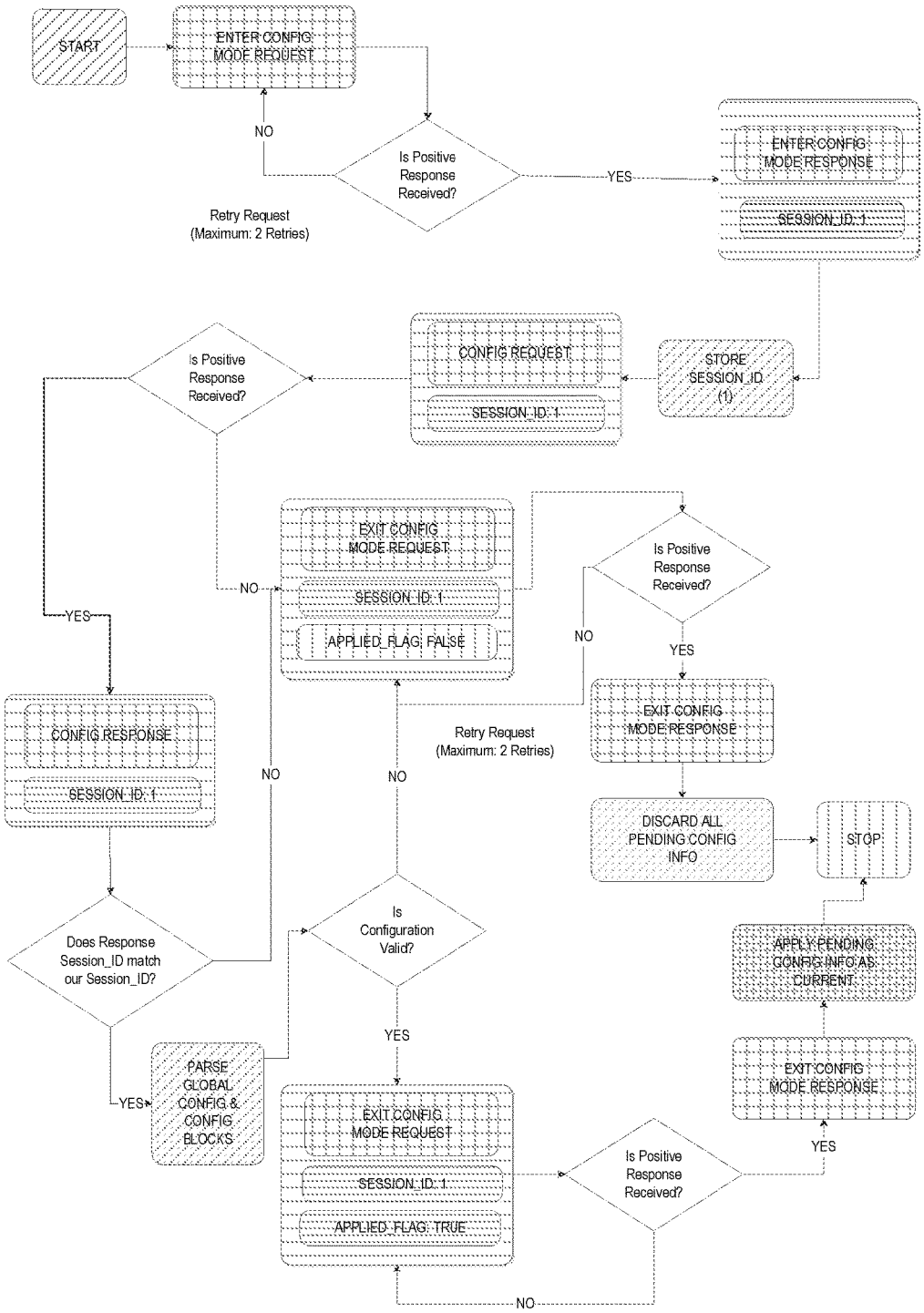
FIG. 7*a* depicts a representative system workflow of the present invention for remote configuration of the data harvesting device by the host system.

FIG. 7*a* depicts a representative system workflow of the present invention for remote configuration of the data harvesting device by the host system. The process flow during initial configuration of the data harvesting device reflects the fact that master configurations for each individual make and model of vehicle are stored centrally, on the host system, and downloaded to the on-board device only when it is installed. Also, relocation of the device to different vehicle with a different VIN triggers a re-configuration of the device to reflect the different configuration of the new vehicles' systems. The flow itself is specifically designed to account for the occasionally unstable nature of cellular data connections and the necessity to repeatedly attempt transactions with the host in a structured manner.

Figure 7B:
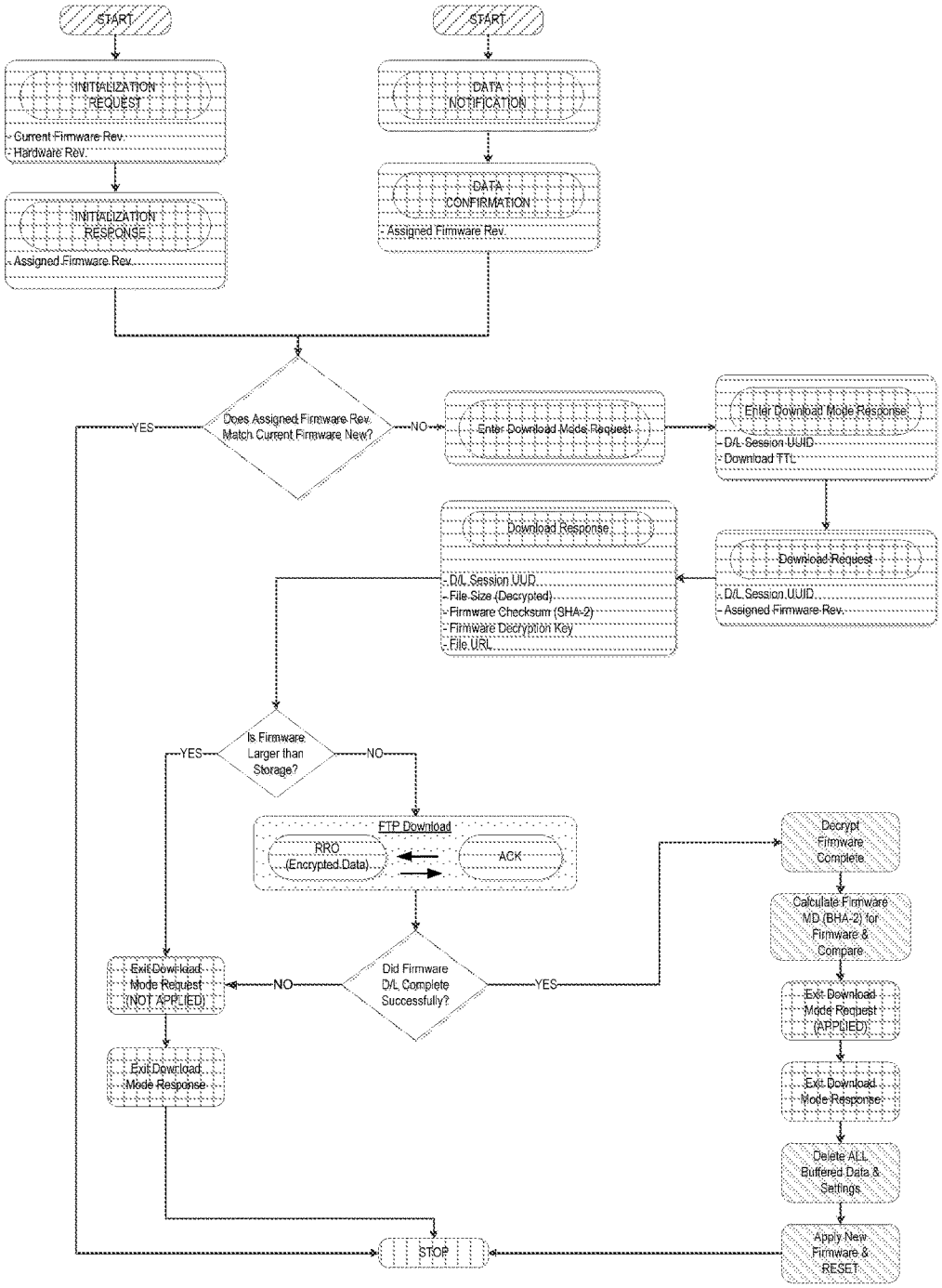
FIG. 7*b* illustrates a representative system workflow of the present invention for managing updates of the data harvesting device programming.
Figure 7C:
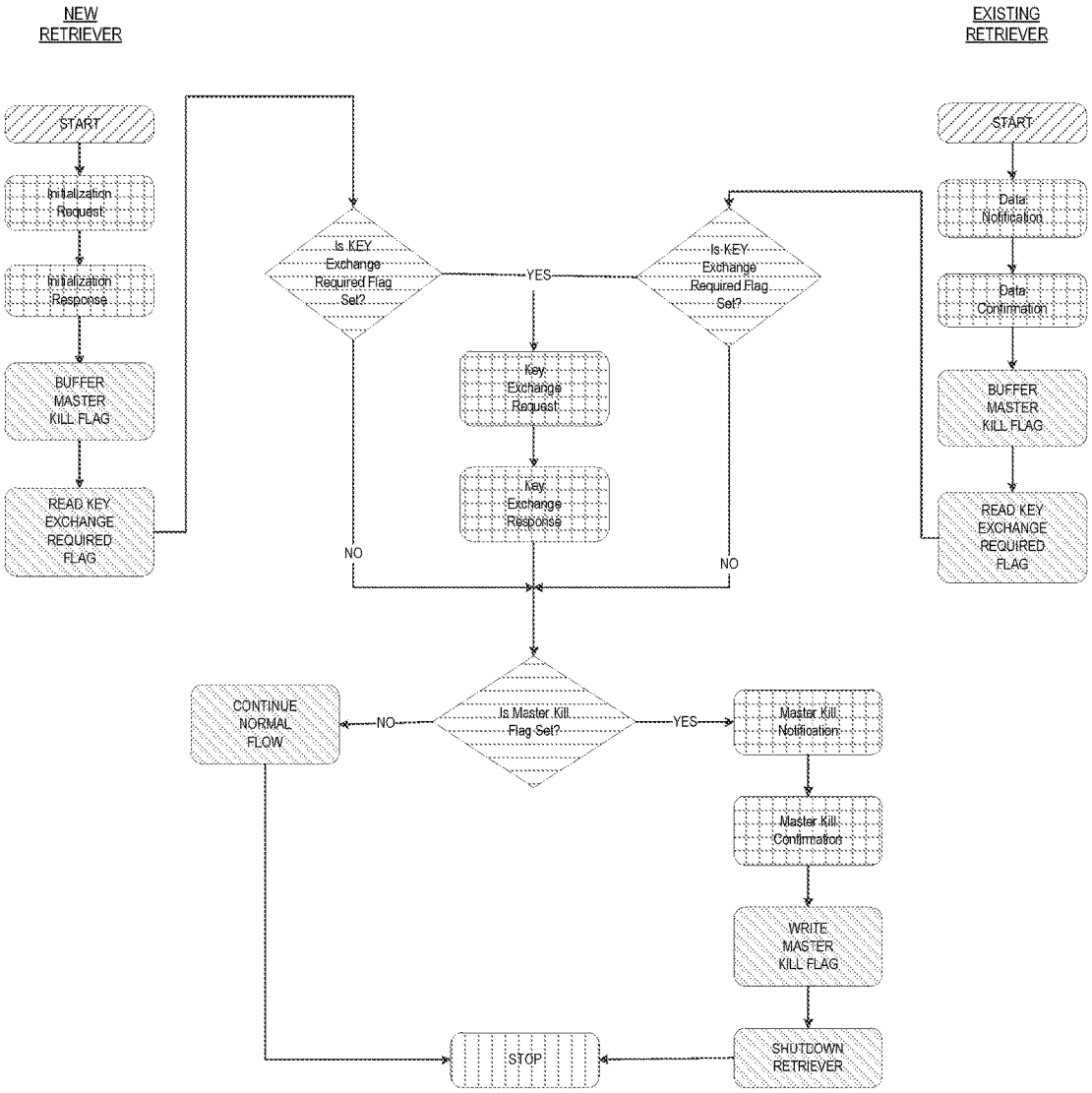
FIG. 7*c* illustrates a representative system workflow of the present invention for management of encryption keys in support of data communications between the data harvesting device and the remote host system.

FIG. 7*b* illustrates a representative system workflow of the present invention for managing updates of the data harvesting device programming. The use of encryption for the firmware package (based on a downloaded key as part of the overall process) ensures security and the use of a supplied checksum value ensures data integrity. The latter feature, as well as the process flow itself, compensates for the occasionally unstable nature of cellular data connections and the necessity to repeatedly attempt transactions with the host in a structured manner FIG. 7*c* illustrates a representative system workflow of the present invention for management of encryption keys in support of data communications between the data harvesting device and the remote host system. Separate management and transmission of encryption keys ensures the security of all data communications between the data harvester and the host, but is also subject to occasional instability of the cellular network. The specific process flow incorporates a series of steps to ensure correct transmission and verification of the keys under all conditions, including those cases which may involve intermittent signal dropout.

Figure 7D:
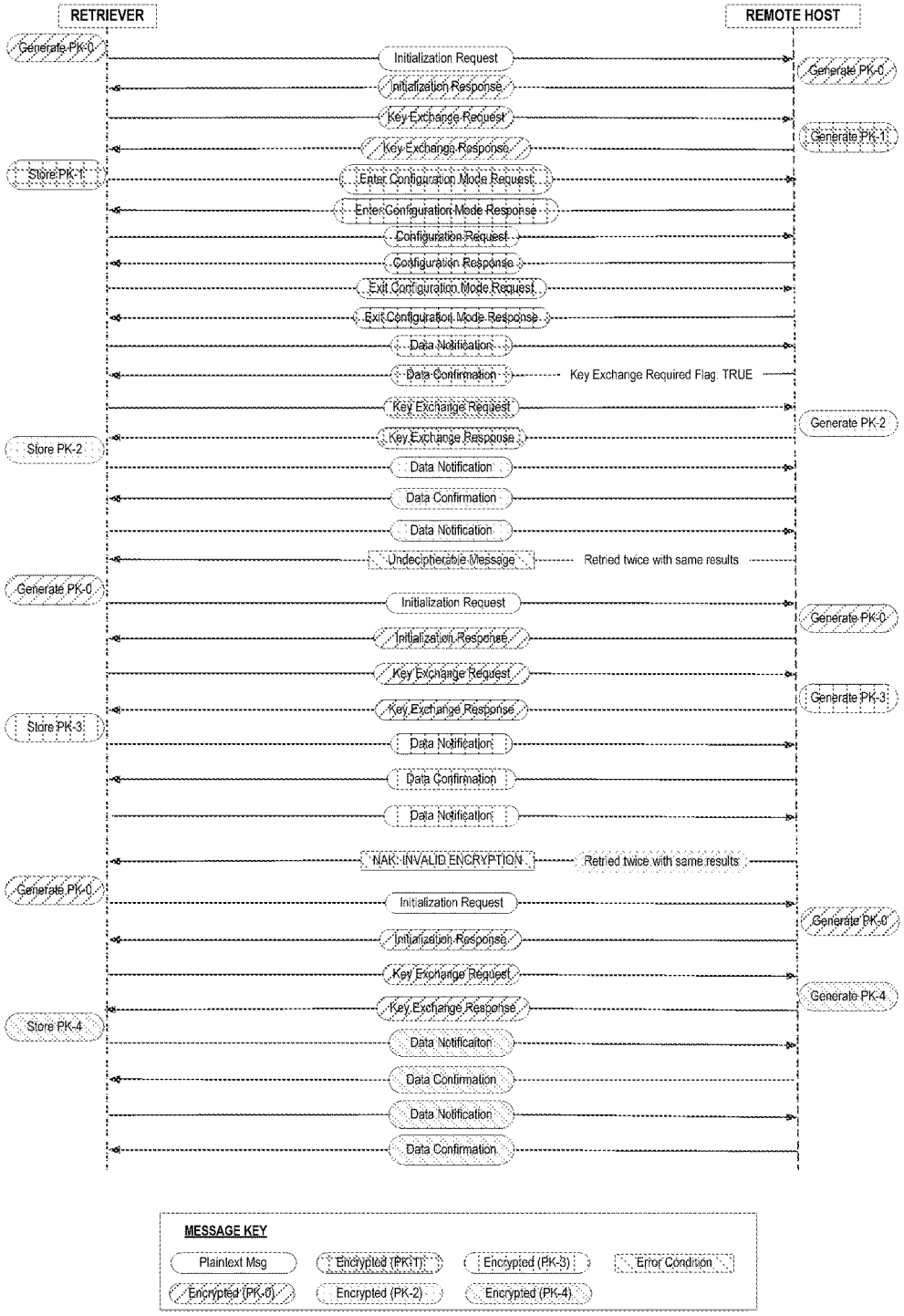
FIG. 7*d* illustrates a representative system workflow of the present invention for disabling the device in the event that a critical device fault is discovered that might jeopardize normal vehicle operations.

FIG. 7*d* illustrates a representative system workflow of the present invention for disabling the device in the event that a critical device fault is discovered that might jeopardize normal vehicle operations, in accordance with the "master kill" method explained above.

Additional Functionality

A Wi-Fi or Zigbee radio transceiver incorporated into the design of the data harvester unit/module provides an alternative, low-cost pathway to and from the central system. In areas with adequate and stable signal strength, this is a viable solution and the data harvester unit/module can then select the most appropriate data path based on prevailing conditions.

Additionally, since Wi-Fi or Zigbee technology has limited range, the automatic process of detecting all available transmitters within the operating radius of the device has the added benefit of detecting proximity to known locations with specific transmitter IDs. In practice, this can be employed to trigger the transmission of operating vehicle data to the central system when the vehicle is in the proximity of a known dealership or other known service provider. The transmission can be made using the Wi-Fi or Zigbee carrier signal, or the cellular channel, whichever is more stable at the time. This allows the service provider to have an up-to-date snapshot of the vehicle status (accessed from the central system) even before it has reached their door.

Implementation

The present systems and related computer programs should not be considered to be limited to a particular type of computer system or computer program implementation. For example, the present systems and methods may be implemented using a distributed and networked computing environment comprising at least one computing device.

The present systems and methods may involve an Internet, intranet or other networked environment. Therefore, any reference to any of Internet, intranet or other networked environment should be understood broadly to encompass not only the referenced term, but all of Internet, intranet or other networked environment. In the same manner terms indicating aspects of either the Internet, an intranet or another networked environment, such as a webpage in an Internet environment, should be understood broadly to include the equivalent available in the Internet, intranet or other networked environment.

Figure 8:
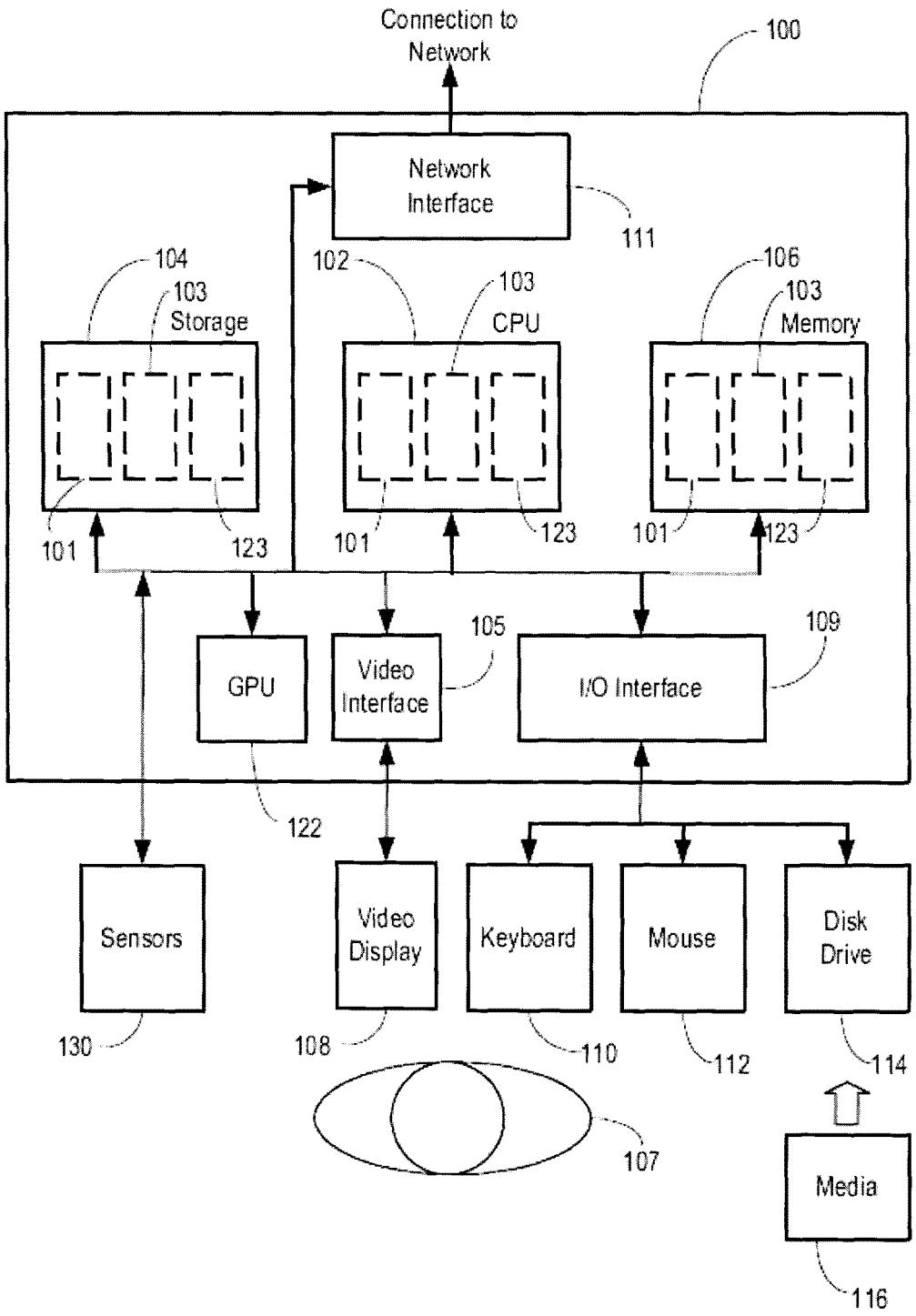
FIG. 8 is a schematic diagram of an illustrative general purpose computing device.

The present systems, methods and related computer programs may be utilized/practiced in various embodiments. The server 64 in particular may be implemented using a suitably configured computer device, and associated communications networks, devices, software and firmware may provide a platform for enabling one or more embodiments as described above. By way of example, as shown in FIG. 8, a generic computer device 100 that may include a central processing unit ("CPU") 102 connected to a storage unit 104 and to a random access memory 106. The CPU 102 may process an operating system 101, application program 103, and data 123. The operating system 101, application program 103, and data 123 may be stored in storage unit 104 and loaded into memory 106, as may be required. Computer device 100 may further include a graphics processing unit (GPU) 122 which is operatively connected to CPU 102 and to memory 106 to offload intensive image processing calculations from CPU 102 and run these calculations in parallel with CPU 102. An operator 107 may interact with the computer device 100 using a video display 108 connected by a video interface 105, and various input/output devices such as a keyboard 110, mouse 112, and disk drive or solid state drive 114 connected by an I/O interface 109. In known manner, the mouse 112 may be configured to control movement of a cursor in the video display 108, and to operate various graphical user interface (GUI) controls appearing in the video display 108 with a mouse button. The disk drive or solid state drive 114 may be configured to accept computer readable media 116. The computer device 100 may form part of a network via a network interface 111, allowing the computer device 100 to communicate with other suitably configured data processing systems (not shown). One or more different types of sensors 130 may be used to receive input from various sources.

The present systems and methods may also be practiced on virtually any manner of computer device including a desktop computer, laptop computer, tablet computer, customized ECU, etc. provided that optimal processing, memory and other hardware/software requirements are met. The present systems and methods may also be implemented as a computer-readable/useable medium that includes computer program code to enable one or more computer devices to implement each of the various process steps in a method in accordance with the present system and method. It is understood that the terms computer-readable medium or computer useable medium comprises one or more of any type of physical embodiment of the program code. In particular, the computer-readable/useable medium can comprise program code embodied on one or more portable storage articles of manufacture (e.g. an optical disc, a magnetic disk, a tape, etc.), on one or more data storage portioned of a computing device, such as memory associated with a computer and/or a storage system.

Other applications are possible, including implementation of the data harvesting and transmission device in light aircraft with transmission of operational data and GPS-based information via cellular technology at low altitudes and satellite technology at intermediate and high altitudes, with appropriate upstream applications for the processing of said data.

The invention claimed is:

1. A method for re-configuring a data harvesting device for deciphering vehicle operation data from a vehicle, the method comprising:

connecting the data harvesting device to a diagnostic port of the vehicle, the diagnostic port being connected to a vehicle internal network bus that interconnects to one or more electronic control units of the vehicle, the data harvesting device configured to communicate through the vehicle internal network bus and to wirelessly communicate with an external network storing data structures representing sets of vehicle-type specific memory locations, the data harvesting device having one or more telemetry functions that utilize one or more data parameters each having memory location mappings identifying memory locations for within one or more data streams provided through the vehicle internal network bus;

accessing the vehicle internal network bus to determine a vehicle information number for the vehicle;

transmitting the vehicle information number to an external server;

receiving a data package having a set of vehicle-type specific memory locations based at least on a decoded vehicle information number from an external server;

determining that the data package is incomplete in relation to the memory location mappings utilized by the one or more telemetry functions and flagging a subset of data parameters as requiring new memory location mappings;

extracting the new memory location mappings for the subset of incomplete memory location mappings through the vehicle internal network bus by, for each data parameter of the subset of flagged data parameters:

accessing the vehicle internal network bus to obtain a list of device-specific arbitration identifiers, each device-specific arbitration identifier being used to identify data on the one or more data streams associated with a corresponding electronic control unit;

determining a reference value for the data parameter based on one or more vehicle operation data values;

extracting, from the vehicle internal network bus using the list of device-specific arbitration identifiers, corresponding one or more data streams from the vehicle internal network bus for each of the electronic control units on the vehicle internal network bus;

scanning the vehicle operation data values provided on the corresponding one or more data streams to identify a set of candidate data values having at least one common feature associated with the reference value within a pre-determined proximity margin;

selecting a final data value in the corresponding one or more data streams from the set of candidate data values;

recording one or more memory location characteristics of the selected final data value in the corresponding one or more data streams;

updating the data package to populate the one or more recorded memory location characteristics in association with a new mapping for the data parameter; and controlling the data harvesting device to, using the updated data package, re-configure the one or more telemetry functions to map the one or more data parameters utilized by the one or more telemetry functions to the vehicle-type specific memory locations.

2. The method of claim 1, wherein the vehicle-type specific memory locations comprise one or more of: retrieval parameters, data request codes, framing specifications, and an indication of whether a response is a single or multi-frame data packet.

3. The method of claim 1, further comprising logging the vehicle operation data values, and wirelessly transmitting the vehicle operation data values to a remote host computer system.

4. The method of claim 1, wherein the vehicle-type specific memory locations are retrieved by the data harvesting device based on the make or model of the vehicle.

5. The method of claim 1, comprising obtaining a Vehicle Identification Number (VIN) of the vehicle from the diagnostic port and determining a make or model of the vehicle based on the VIN.

6. The method of claim 5, comprising, before obtaining the vehicle operation data values, requesting, by the data harvesting device, the VIN from the diagnostic port of the vehicle and subsequently receiving the VIN in response to the request.

7. The method of claim 1, wherein obtaining the vehicle operation data values comprises polling the vehicle internal network bus based on the decoded vehicle information number.

8. The method of claim 7, wherein polling comprises sending a request to the vehicle internal network bus and receiving a response based on the request.

9. The method of claim 1, wherein the vehicle operation data values comprises real time or near real time information regarding operational or maintenance status of the vehicle.

10. The method of claim 1, wherein the reference value comprises an odometer value.

11. The method of claim 1, further comprising: uploading, by the data harvesting device, the updated data package to the external network.

12. The method of claim 1, wherein the flagged subset of data parameters includes one or more non-standardized data parameters.

13. The method of claim 12, wherein the one or more non-standardized data parameters includes at least an odometer reading.

14. The method of claim 13, wherein the step of determining the reference value for extracting the new memory location mappings for the odometer reading includes:

obtaining a baseline odometer data value;

extracting, from the one or more data streams, a data value for a baseline distance travelled since diagnostic codes were cleared;

extracting, from the one or more data streams, a data value for a current reading of a distance travelled since the diagnostic codes were cleared;

determining a current odometer data value using at least the baseline odometer data value, the data value for the extracted baseline distance travelled since the diagnostic codes were cleared, and the data value for the current reading of a distance travelled since the diagnostic codes were cleared.

15. A system for extracting vehicle operation data from a vehicle, the system comprising:

a data harvesting device adapted to be connected to a diagnostic port of the vehicle, the diagnostic port being connected to a vehicle internal network bus that interconnects to one or more electronic control units of the vehicle, the data harvesting device configured to communicate through the vehicle internal network bus and to wirelessly communicate with an external network storing data structures representing sets of vehicle-type specific memory locations, the data harvesting device having one or more telemetry functions that utilize one or more data parameters each having memory location mappings identifying memory locations for within one or more data streams provided through the vehicle internal network bus, the data harvesting device having a storage medium and a micro-processor;

wherein the data harvesting device, upon executing of instructions stored in the storage medium by the microprocessor, is configured to:

access the vehicle internal network bus to determine a vehicle information number for the vehicle;

transmit the vehicle information number to an external server;

receive a data package having a set of vehicle-type specific memory locations based at least on a decoded vehicle information number from an external server determine that the data package is incomplete in relation to the memory location mappings utilized by the one or more telemetry functions and flagging a subset of data parameters as requiring new memory location mappings;

extract the new memory location mappings for the subset of incomplete memory location mappings through the vehicle internal network bus by, for each data parameter of the subset of flagged data parameters:

accessing the vehicle internal network bus to obtain a list of device-specific arbitration identifiers, each device-specific arbitration identifier being used to identify data on the one or more data streams associated with a corresponding electronic control unit;

determining a reference value for the data parameter based on the one or more vehicle operation data values;

extracting, from the vehicle internal network bus using the list of device-specific arbitration identifiers, corresponding one or more data streams from the vehicle internal network bus for each of the electronic control units on the vehicle internal network bus;

scanning the vehicle operation data values provided on the corresponding one or more data streams to identify a set of candidate data values having at least one common feature associated with the reference value within a pre-determined proximity margin;

selecting a final data value in the corresponding one or more data streams from the set of candidate data values;

recording one or more memory location characteristics of the selected final data value in the corresponding one or more data streams;

updating the data package to populate the one or more recorded memory location characteristics in association with a new mapping for the data parameter; and control the data harvesting device to, using the updated data package, re-configure the one or more telemetry functions to map the one or more data parameters utilized by the one or more telemetry functions to the vehicle-type specific memory locations.

16. The system of claim 15, wherein the vehicle-type specific memory locations comprise one or more of: retrieval parameters, data request codes, framing specifications, and an indication of whether a response is a single or multi-frame data packet.

17. The system of claim 15, further comprising a remote host computer system, wherein the data harvesting device is further configured to log the vehicle operation data values, and to wirelessly transmit the vehicle operation data values to the remote host computer system.

18. The system of claim 17, wherein the remote host computer system comprises a digital library that stores a configuration data, which comprises processing rules for processing the vehicle operation data values based on standardized codes and for processing non-standard vehicle operation data values based on the make or model of the vehicle.

19. The system of claim 15, wherein the data harvesting device is configured to retrieve the vehicle-type specific memory locations based on the make or model of the vehicle.

20. The system of claim 15, wherein the data harvesting device is configured to obtain a Vehicle Identification Number (VIN) of the vehicle from the diagnostic port and determine a make or model of the vehicle based on the VIN.

21. The system of claim 20, wherein the data harvesting device is configured to, before obtaining the vehicle operation data values, request the VIN from the diagnostic port of the vehicle and subsequently receive the VIN in response to the request.

22. The system of claim 15, wherein the data harvesting device is configured to obtain the vehicle operation data values by polling the vehicle internal network bus based on the decoded vehicle information number.

23. The system of claim 15, wherein the vehicle operation data values comprises real time or near real time information regarding operational or maintenance status of the vehicle.

24. The system of claim 15, wherein the reference value comprises an odometer value.

* * * * *